United States Patent [19]

Yamaguchi et al.

[11] Patent Number: 5,021,828

[45] Date of Patent: Jun. 4, 1991

[54] COPYING APPARATUS HAVING A CONSUMABLE PART

[75] Inventors: Junichi Yamaguchi; Izumi Takahashi; Masafumi Matsumoto, all of Kanagawa, Japan

[73] Assignee: Fuji Xerox Co., Ltd., Tokyo, Japan

[21] Appl. No.: 333,144

[22] Filed: Apr. 4, 1989

[30] Foreign Application Priority Data

Apr. 15, 1988 [JP] Japan ..... 63-91677

[51] Int. Cl.[5] ..... G03G 21/00

[52] U.S. Cl. ..... 355/209

[58] Field of Search ..... 355/204, 206, 209, 211, 355/205, 245, 260, 210

[56] References Cited

U.S. PATENT DOCUMENTS

| | | | |
|---|---|---|---|
| 4,496,237 | 1/1985 | Schron | 355/209 |
| 4,521,102 | 6/1985 | Motomura et al. | 355/206 |
| 4,551,000 | 11/1985 | Kanemitsu et al. | 355/210 |
| 4,585,327 | 4/1986 | Suzuki | 355/211 |
| 4,591,258 | 5/1986 | Nishino et al. | 355/211 X |
| 4,598,993 | 7/1986 | Mizutani et al. | 355/211 |
| 4,634,258 | 1/1987 | Tanaka et al. | 355/326 X |
| 4,705,388 | 11/1987 | Huntsens et al. | 355/204 |
| 4,708,748 | 11/1987 | Ohtsuka et al. | 358/298 |
| 4,803,521 | 2/1989 | Honda | 365/210 X |

FOREIGN PATENT DOCUMENTS

| | | |
|---|---|---|
| 0227488 | 7/1987 | European Pat. Off. . |
| 57-163276 | 10/1982 | Japan . |
| 2097332 | 11/1982 | United Kingdom . |

*Primary Examiner*—Arthur C. Prescott

*Attorney, Agent, or Firm*—Finnegan, Henderson, Farabow, Garrett & Dunner

[57] ABSTRACT

A storage apparatus such as a copier or facsimile machine which stores information on paper and uses parts which the operator replaces upon expiration because of consumption of the part or deterioration of the part. A system is provided so that the consumable part can have its life-time measured by devices on the main body of the storage apparatus. Each consumable part has an indication of what stage of consumption or state within its life-time that it has reached. That is, for a copier after a certain number of copies are made one of a number of fuses in the consumable part can be fused as an indication of the state of the part.

17 Claims, 21 Drawing Sheets

FIG. 6A
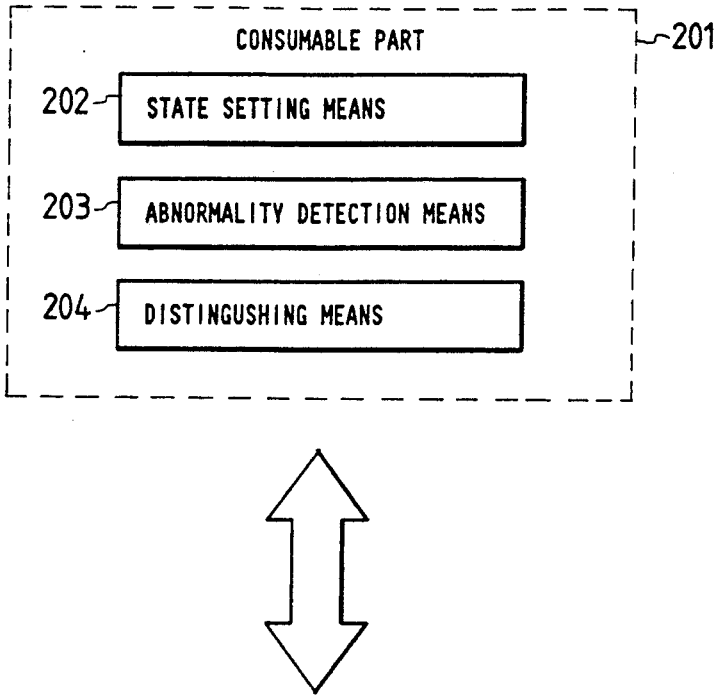
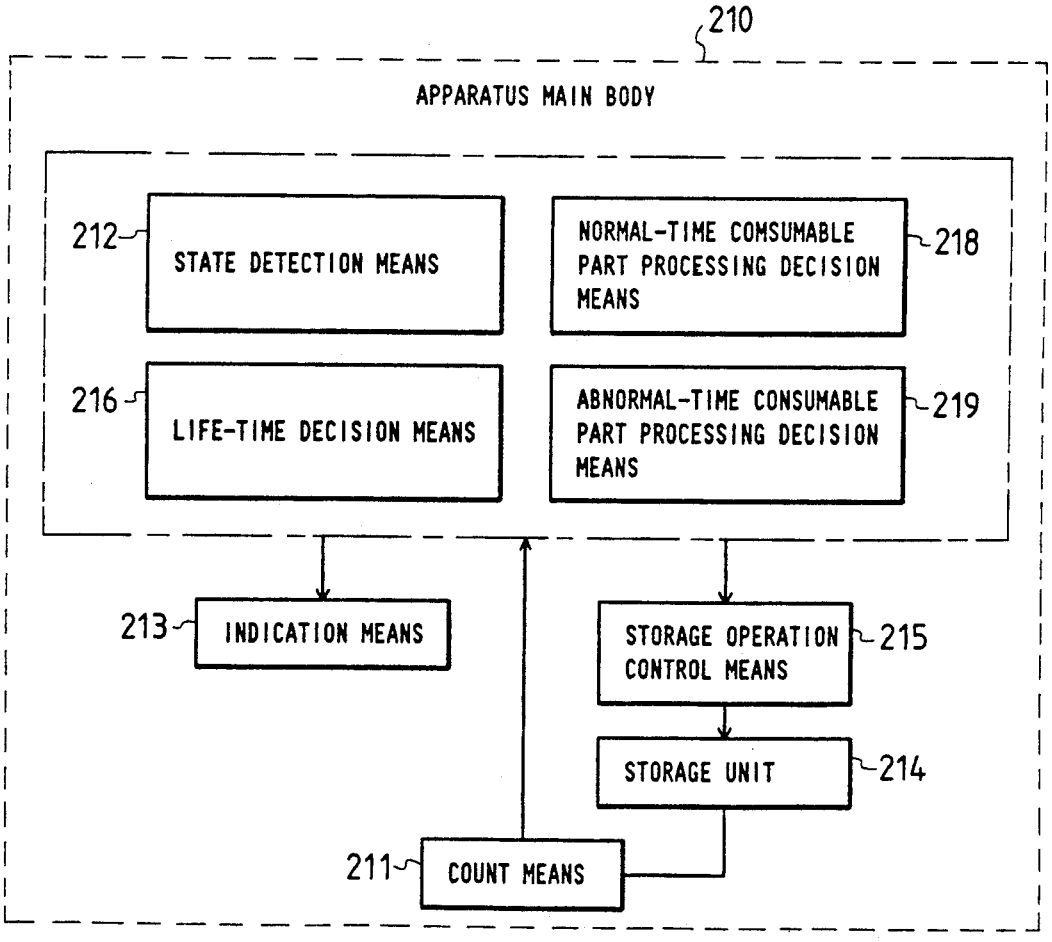

FIG. 26

PROCESSING WHEN REPLACING CRU AT NORMAL TIME (NOT J9, J7, IMMEDIATE J7)

| | OLD → NEW | INITIALIZE COUNTER | USER COUNTER | NOTE |
|---|---|---|---|---|
| A. | CRU-1→CRU-1 | CONTINUE COUNT | HOLD | |
| B. | T1 → T2 | HOLD | IF USER COUNTER < 16K COUNTINUE COUNT<br>IF USER COUNTER ≧ 16K COUNTINUE COUNT<br>IF USER COUNTER ≧ 18K HOLD | IF USER COUNTER ≧ 16K FUSE-2 CUT & LED BLINK AFTER 1 COPY OPERATION<br>IF USER COUNTER ≧ 18K OCCUR J7 |
| C. | T1 → T3 | HOLD | IF USER COUNTER < 16K HOLD<br>IF USER COUNTER ≧ 16K COUNTINUE COUNT<br>IF USER COUNTER ≧ 18K HOLD | IF USER COUNTER < 16K OCCUR IMMEDIATE J7<br>IF USER COUNTER ≧ 16K LED BLINK<br>IF USER COUNTER ≧ 18K OCCUR J7 |
| D. | T2 → T1 | CONTINUE COUNT | HOLD | |
| E. | T2 → T2 | HOLD | CONTINUE COUNT | |
| F. | T2 → T3 | HOLD | HOLD | OCCUR IMMEDIATE J7 |
| G. | T3 → T1 | CONTINUE COUNT | HOLD | |
| H. | T3 → T2 | HOLD | CONTINUE COUNT | FUSE-2 CUT AND LED BLINK AFTER 1 COPY OPERATION |
| I. | T3 → T3 | HOLD | CONTINUE COUNT | LED BLINK |

FIG. 29

PROCESSING WHEN REPLACING CRU UPON OCCURANCE OF J7 (USER COUNTER ≧ 18K)

| | (PREV. 2)→PREV. 1→NEW | INITIALIZE COUNTER | USER COUNTER | NOTE |
|---|---|---|---|---|
| A. | J7(18K) → T1 → T2 | HOLD | HOLD | OCCUR J7 |
| B. | J7(18K) → T1 → T3 | HOLD | HOLD | OCCUR J7 |
| C. | J7(18K) → T1 | ※ | HOLD | |
| D. | J7(18K) → T2 | HOLD | HOLD | CONTINUE J7 |
| E. | J7(18K) → T3 | HOLD | HOLD | CONTINUE J7 |

※ AFTER TRANSITION OF CONDITION FROM T1 TO T2 AS A RESULT OF COPY, IF FIRST J7 (USER COUNTER ≧ 18K) THEN CLEARED TO ZERO, IF NOT, NOT CLEARED BUT CONTINUES TO COUNT.

FIG. 30

PROCESSING WHEN REPLACING CRU UPON OCCURANCE OF J7
(18K > CSER COUNTER ≧ 16K, SUMP FULL)

| | (PREV. 2) → PREV. 1 → NEW | INITIALIZE COUNTER | USER COUNTER | NOTE |
|---|---|---|---|---|
| A. | J7(SUMP FULL) → T1 →T2 | HOLD | CONTINUE COUNT | FUSE-2 CUT AND LED BLINK AFTER 1 COPY OPERATION |
| B. | J7(SUMP FULL) → T1 →T3 | HOLD | CONTINUE COUNT | LED BLINKING |
| C. | J7(SUMP FULL) → T1 | ※ | HOLD | |
| D. | J7(SUMP FULL) → T2 | HOLD | HOLD | CONTINUE J7 |
| E. | J7(SUMP FULL) → T3 | HOLD | HOLD | CONTINUE J7 |

※ AFTER TRANSITION OF CONDITION FROM T1 TO T2 AS A RESULT OF COPY, IF FIRST J7 (18K > USER COUNTER ≧ 16K, SUMP FULL) THEN CLEARED TO ZERO, IF NOT, NOT CLEARED BUT CONTINUES TO COUNT.

FIG. 27

PROCESSING WHEN REPLACING CRU UPON OCCURANCE OF J9

| | (PREV. 2) → PREV. 1 → NEW | INITIALIZE COUNTER | USER COUNTER | NOTE |
|---|---|---|---|---|
| A. | J9 → T1 → T2 | HOLD | CONTINUE COUNT | |
| B. | J9 → T1 → T3 | HOLD | HOLD | OCCUR IMMEDIATE J7 |
| C. | J9 → T2 → T3 | HOLD | HOLD | OCCUR IMMEDIATE J7 |
| D. | J9 → T1 | ※ | HOLD | |
| E. | J9 → T2 | HOLD | CONTINUE COUNT | |
| F. | J9 → T3 | HOLD | HOLD | OCCUR IMMEDIATE J7 |

※ AFTER TRANSITION OF CONDITION FROM T1 TO T2 AS A RESULT OF COPY, IF FIRST "J9" THEN CLEARED TO ZERO, IF NOT, CLEARED BUT CONTINUES TO COUNT.

FIG. 28

PROCESSING WHEN REPLACING CRU UPON OCCURANCE OF IMMEDIATE J7

| | (PREV. 2) → PREV. 1 → NEW | INITIALIZE COUNTER | USER COUNTER | NOTE |
|---|---|---|---|---|
| A. | IMMEDIATE J7→T1→T2 | HOLD | CONTINUE COUNT | |
| B. | IMMEDIATE J7→T1→T3 | HOLD | HOLD | OCCUR IMMEDIATE J7 |
| C. | IMMEDIATE J7→T2→T3 | HOLD | HOLD | OCCUR IMMEDIATE J7 |
| D. | IMMEDIATE J7→T1 | ※ | HOLD | |
| E. | IMMEDIATE J7→T2 | HOLD | CONTINUE COUNT | |
| F. | IMMEDIATE J7→T3 | HOLD | HOLD | OCCUR IMMEDIATE J7 |

※ AFTER TRANSITION OF CONDITION FROM T1 TO T2 AS A RESULT OF COPY, IF FIRST "IMMEDIATE J7" THEN CLEARED TO ZERO, IF NOT, NOT CLEARED BUT CONTINUES TO COUNT.

COPYING APPARATUS HAVING A CONSUMABLE PART

FIELD OF THE INVENTION

The present invention relates to a storage apparatus such as an electronic copier, a facsimile apparatus, and a printer and to consumable parts used therefor, and in more detail to a storage apparatus that is provided with functions for supervising the life-time of the consumable parts such as sensitive material and a mechanism for varying reduction/enlargement rates.

BACKGROUND OF THE INVENTION

With miniaturization of small-size components, image formation devices such as a copier, a facsimile apparatus, and a printer have been developed by many manufacturers which are relatively low priced and small. Such devices can control with a high level of accuracy with the aid of a microcomputer equipped therein and are often comparable to large size apparatus in terms of the functions they perform though their storage speed is relatively slow.

A relatively large size storage apparatus processes a large number of documents in a month. Frequently these type of apparatus are used for business purposes which require a high degree of reliability. Thus, a maintenance contract is necessary to maintain the apparatus in a good working condition at all times. The maintenance expense per sheet of documents is small compared to the total number of documents processed.

On the other hand, a relatively small apparatus may process a small amount of documents per month. For small offices or households that use one such apparatus, the maintenance expense will represent a substantial portion of the cost per sheet of documents processed if they purchase a maintenance contract on a yearly basis, for example. Therefore these type of users may purchase a so-called spot maintenance contract where a serviceman is called when the apparatus malfunctions. For such a spot contract the travel expenses and technical charges are relatively expensive as compared to the cost of the parts; therefore an apparatus which allows users to replace consumable parts and parts that have a greater chance of malfunctioning would be desirable.

A duplicator, which allows the users to replace the consumable part having toner therein, has been proposed in Japanese Patent Preliminary Publications No. 57-163276. FIG. 1 illustrates the duplicator wherein a sensitive material drum 2 formed of a photo-conductive layer and an electrically conductive drum is disposed at the center of the duplicator 1. The sensitive material drum 2 is rotatable in the direction of the arrow. Around sensitive material drum 2 are positioned a corona charger (charge corotron) 3, a short focal optical element array 4, a developing machine 5, a transfer corona discharger (transfer corotron) 6, and a cleaner 7. Sensitive material drum 2, corona discharger 3, developing machine 5, and cleaner 7 form a process kit that is made as a single unit which is detachably mounted to the apparatus main body. A frame side-plate 8 supports these components in a unitary construction.

A document supporter 9 of this apparatus is illuminated by a document-illuminating lamp 10. Paper from a transfer material feeding tray 11 is delivered between delivery rollers 12 and timing rollers 13 through a guide member 14, and passes between the sensitive material drum 2 and the transfer corona discharger 6, during which a toner image is transferred. The paper to which the toner image has been transferred passes through a delivery path 15 and is fixed by a fixer (a heat roll and a pressure roll). After being fixed, the paper is discharged onto a copy tray 18 by a takeup roller 17.

This type of duplicator uses a consumable part called the process kit and the kit can be replaced by a new process kit when a malfunction occurs and damages the sensitive material drum 2. If no malfunction occurs, then the process kit can be used until all of the toner in the developing machine 5 is used up or cleaner 7 is full of toner.

The process kit or replaceable consumable part is replaced whenever it is necessary and there will be less chances of trouble if the amount of toner, etc., is set so that the kit can be replaced before its performance has deteriorated. Under such situations, the users of the duplicator are interested in the total number of copies that can still be made from that process kit or remaining copies that can be made from that kit. Thus, the process kit of this proposed duplicator is provided with a counter that counts the total time interval during which the sensitive material drum 2 is in use and total number of images formed.

FIGS. 2 to 4 illustrate a first example of the counter used in the disclosed apparatus. FIG. 2 shows a side view of a relevant portion of the process kit and FIG. 3 illustrates a front view of the process kit. A pin 20 projects from the sensitive material drum 2. Pin 20 causes a ratchet gear 21 to rotate by one tooth when the sensitive material drum 2 makes one rotation. Rotation of ratchet gear 21 is restrained by a leaf spring 22. A pin 23 projects from ratchet gear 21. One rotation of ratchet gear 21 causes ratchet gear 24 to rotate by one tooth. Rotation of ratchet gear 24 is restrained by a leaf spring 25. The ratchet gear 24, rotates in the direction of the arrow, and is secured to a disk 26 that is a life-time indicator. Disk 26 is provided with a color stripe 27, extending in radial direction. The position of the color stripe 27 is indicative of the life-time of the sensitive material drum 2.

FIG. 4 shows this proposed process kit mounted in place. A process kit cover 28 has an opening 29 through which the color stripe 27 on the disk 26 mounted on ratchet gear 24 shown in FIG. 28 can be seen when in a position indicative of the expiration of the life-time of the sensitive material drum 2.

On the other hand, FIG. 5 shows a second example of the counter used in this proposed apparatus. Sensitive material drum 2 is positioned within the kit cover 28. A count circuit 35 which is used as a measurement mechanism and a power supply 36 are disposed within the kit cover 28. Power supply 36 is arranged in such a way that when the insulative kit cover 28 is set into the the main body, a terminal 37 is inserted into a switch plug of the main body to complete a circuit including a switch 39 and a count circuit 35. The number of rotations of the sensitive material drum 2 is accumulated in accordance with the switching of ON/OFF of switch 39. Since the count circuit 35 is energized by the power supply 36 at all times, a count of the rotations over time can be stored. Thus, when the accumulated count becomes greater than a predetermined value, an LED (light emitting diode) element 40 flashes to indicate that the life time of the kit is close to expiring.

With the apparatus thus far described, the rotation of the sensitive material drum 2 is detected mechanically or electrically, and is used, accordingly, to decide the life-time of the consumable parts. This type of apparatus, however, suffers from the following problems.

(i) As shown in FIG. 1, since this proposed process kit comprises the developing machine 5, the life-time thereof expires when all of the toner is used up even if the life-time of the sensitive material drum 2 has not yet expired. The toner is a powder for developing a static latent image formed on the sensitive material drum 2 and the amount used varies greatly in accordance with the condition of the static latent image. For example, in FIG. 1, copying from a document of a relatively small size or a blackish document, with the cover of the document supporter 9 not shown being opened, causes much of toner to be used on black portions and background portions of the image to cause a considerably large amount of toner to be used. Frequent copy operation in such a manner causes the process kit to run out of toner before any indication of the expiration of the life-time of the process kit is displayed. That is, this proposed mechanical or electrical counter does not predict the life-time of a process kit in a reliable way.

(ii) On the other hand, considering the cost of a storage apparatus, the process kit should be worth the money that the user pays for the consumable parts. In the storage apparatus, the economical value of the kit should not be measured in terms of how many grams of toner can be used but should be evaluated in terms of how many copies can be made from the kit. The economical value of the consumable part can only be evaluated based on how many copies can be guaranteed. For example, if the toner leaks from developing machine 5 due to an initial problem with the consumable part, reordering a new consumable part just because the toner has run out is not economical.

SUMMARY OF THE INVENTION

An object of the present invention is to provide a storage apparatus in which the life-time of a consumable part is supervised and guaranteed in terms of the number of copies that can be made.

Another object of the invention is to provide a storage apparatus in which the life-time of a consumable part is supervised and guaranteed in terms of the actual number of copies made by the user, excluding the copies made by a serviceman or during factory alignment from the total number of copies made by that storage apparatus.

Still another object of the invention is to provide a storage apparatus in which the number of copies made by the serviceman during service operation can be independently supervised.

Yet another object of the invention is to provide a storage apparatus in which levels of consumption of a consumable part can be set in step-wise.

A further object of the invention is to provide a storage apparatus in which even when a consumable part is replaced before it is used up by a consumable having a different level of consumption, the life-time thereof can still be supervised and guaranteed.

A still further object of the invention is to provide a storage apparatus in which when a consumable part that has been unloaded from the storage apparatus before it is used up an enormous setting of the level of consumption can be avoided.

These and other objects are attained by a storage apparatus comprising a main body, a consumable part detachably coupled to the main body, counting means for counting the number of copies made with a specific consumable part, state dictation means for dictating consumption levels of the consumable part, and life-time decision means for deciding a life-time of the consumable part in response to the state dictation means and counting means.

BRIEF DESCRIPTION OF THE DRAWINGS

The accompanying drawings, which are incorporated in constitute a part of this specification, illustrate one embodiment of the invention and, together with the description, serve to explain the principles of the invention.

FIG. 6A is a block diagram illustrating the relationship between elements of the consumable part of the present invention and a storage apparatus;

FIG. 26 is an illustrative diagram representing cases in which the sensitive material cartridge is replaced;

FIG. 27 is an illustrative diagram representing cases in which a sensitive material cartridge with "J9" having been set is replaced;

FIG. 28 is an illustrative diagram representing cases in which a sensitive material cartridge with "immediate J7" having been set is replaced;

FIG. 29 is an illustrative diagram representing a case in which a sensitive material cartridge with "J7" having been set and more than 18000 sheets of copies having been made is replaced;

FIG. 30 is an illustrative diagram representing a case in which a sensitive material cartridge with "J7" having been set and the sump being full of the recovered toner is replaced upon "J7"; an FIG. 31 is an illustrative diagram representing summary of control logic for replacement of the sensitive material cartridge.

PREFERRED EMBODIMENT

Figure 1:
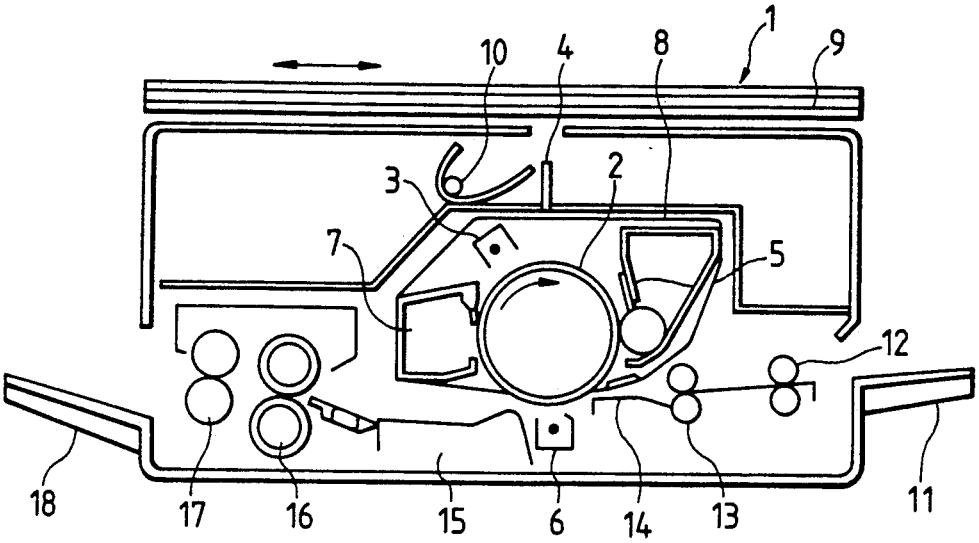
FIG. 1 is a cross sectional diagram of a known duplicator.
Figure 2:
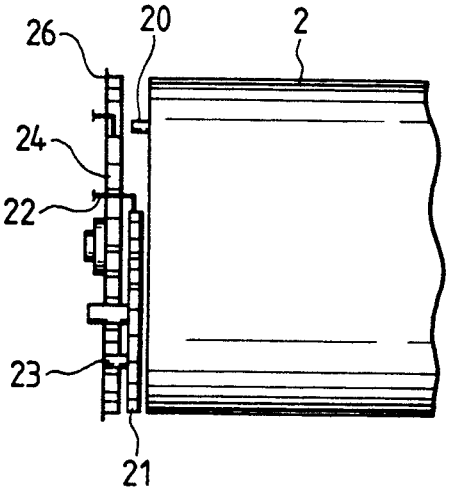
FIG. 2 is a side view of a portion of the duplicator of FIG. 1.
Figure 3:
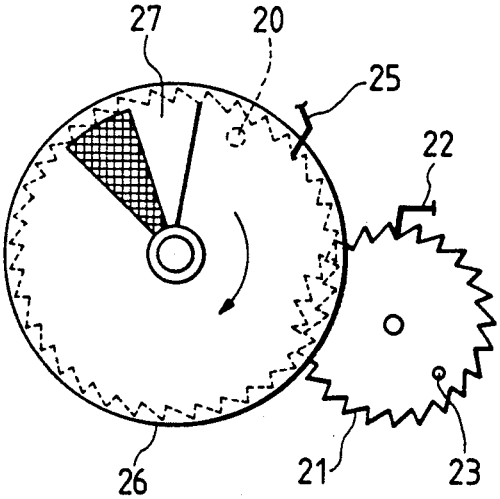
FIG. 3 is a plane front view of the portion of FIG. 2.

In the present invention a consumable part is provided with a consumable material and state-setting means for setting in step-wise the levels of materials being consumed to detect the level of consumption of the part. The apparatus is provided with a main body to which the consumable part can be detachably loaded, counting means for counting the number of copies made with a specific consumable parts being loaded to the main body of the apparatus, state detecting means for detecting the level of consumption that is indicated by the consumable part, and life-time decision means for deciding the life-time of the consumable part on the basis of the detection result from the state detecting means and the count value from the count means. The counted value from the counting means and the result of the state detection means are used together in supervision of the life-time of the consumable part.

The apparatus of the present invention is provided with the counting means defined above, state detection means, abnormality detection means for detecting an abnormal state of the consumable part, and life-time decision means for deciding the life-time of the consumable part on the basis of the above three inputs. Supervision of or warranty of the consumable part can still be done even in an abnormal case such as when a cartridge having a developing machine that becomes full of toner before a predetermined count value is reached.

The apparatus is further provided with transfer means for transferring a toner image onto a sheet of paper, a paper detection means for detecting each sheet of paper that receives a toner image, a logic means for receiving the output from the paper detection means and generating an output upon a predetermined condition being satisfied, and a first counting means for counting the output from the logic means. The count value of the consumable part can be accurately counted without counting the delivered amount of sensitive material but instead counting the number of pieces of paper onto which the toner image is transferred.

The apparatus defined above is provided with a second counting means for counting the output from the paper detection means except for those outputted by the logic means. Thus, trial use of paper will not adversely affect the set point value of the life-time of the consumable part when manufacturing the apparatus, installing the apparatus, or servicing the apparatus.

The apparatus may be provided with a third counter, consumption level setting means for step-wise setting the level of consumption of a predetermined consumable part in accordance with the counted value of the third counter, and life-time prediction means for detectinq the expiration of the life-time of the part when the level of consumption set by the consumption level setting means reaches its ultimate state. A plurality of fuses may be disposed to fuse one after another to allow step-wise indication of the level of consumption of the consumable part.

The apparatus may be provided with a main body the third counter consumption level setting means for setting in step-wise the level of consumption of a predetermined consumable part in accordance with the counted value of the third counter, loading-timing detection means for detecting a timing at which the consumable part is loaded into the main body of the storage apparatus, consumption-comparison means for comparing the level of consumption of the consumable part before and after it is loaded into the main body of the apparatus, life-time setting means for setting the life-time of the consumable part currently loaded into the main body of the apparatus to a predetermined value on the basis of the comparison result from the consumption-comparison means and the content of the third counter. Thus even when the consumable part is replaced before it is used up, the life-time setting of the consumable part is correct.

According to the invention, the apparatus may be provided with condition detection mean for detecting the condition in which the consumable part is mounted into the main body of the apparatus and count means for counting the number of sheets of paper on which storage has been performed, normal-time consumable part process decision means for deciding the processing of the consumable part loaded in accordance with the condition detected by the condition detecting means and the count value of the counting means.

The consumable part can be properly processed in accordance with the condition of the consumable part and the counted value of the counting means. Such processes include inhibiting the counting of the count means and changing the condition of the consumable part to another state as set forth previously. A change in state of the consumable part sometimes requires the user's agreement, in which case a confirmation-indicating means is provided for the user to confirm the change before the condition of the consumable part is actuallly changed. The confirmation-indicating means may indicate by codes to save the number of characters, or by sentences that describe the change of the state or contents of the change.

According to the invention, the apparatus is also provided with abnormal consumable part process decision means for deciding the process of the loaded consumable part in accordance with the state detected by the abnormality-detecting means and the count value of the counting means.

A proper measure can be taken with respect to a new consumable part in the case where an abnormal condition occurs in the consumable part or the life-time of the part expires. At this time, the new part is not necessarily a brand new part.

The invention may be provided with a distinguishing means mounted on the consumable part and having a required electrical property, a comparison mean disposed on the main body for comparing the property of the distinguishing means with a preselected property, and a main body control means for setting the main body of the apparatus to an operative state when the comparison means detects coincidence.

When a consumable part used for different models of devices or when consumable parts not manufactured to specific requirements are loaded into the main body of the apparatus, the invention can distinquish these parts and inhibit the operation of the apparatus to prevent damage thereto and prevent poor picture quality.

The apparatus defined above may be provided with a counting means, a use-inhibiting means for inhibiting the use of a specific consumable part when the counting means has counted the number of sheets on which an information storage operation has been performed is in excess of a predetermined count with respect to this consumable part. Thus, when the count reaches the value representative of the life-time of the part, the use of the part is forcibly disabled to prevent problems in processing additional sheets with a part having degraded quality.

The apparatus may be provided with a storage means that can perform storage operations on a plurality of sheets in succession and a use-inhibition delaying means for delaying operation of the use-inhibitting means until the storage means comprises a series of storage operations. Thus, for example, while five successive sheets are being copied, the copy operation may be continued until it is completed even though the counted value reaches the limit to prevent delay needed to change the consumable part.

The apparatus may be a volatile memory disposed in the main body of the apparatus, a battery for backing up the volatile memory, a voltage detection means connected to a power supply with the main body of the apparatus being energized by this power supply for detecting in terms of its voltage that life-time of the battery is close to expiration, and a display means for displaying the detection result by the voltage detection means.

According, the battery life-time can be predicted before it actually expires so that information written into the volatile memory can be stored reliably. This is particulary useful when the count means utilizes the volatile memory.

According to the invention, the apparatus is provided with a detection means for detecting that the consumable part is unloaded from the main body of the apparatus and consumption-level-change inhibiting means for inhibiting the consumption-level setting means from changing consumption level when the detection means detects unloading of the consumable part. Thus, when renewing the life-time of a relatively new consumable part, even if an older consumable part is set into the appartus, the apparatus prevents a case in which an actual life-time expires much earlier than the indicated life-time due to an incorrect setting life-time setting.

The apparatus may be provided first and a second shut-off switches mounted on the consumable part, a count means mounted on the main body of the apparatus for counting the life-time of the consumable part, a first current supply means for supplying the first shut-off switch with current to shut it off when the count means performs a first count, and a second current supply means for supplying the second shut-off switch with current to shut it off when the count means reaches a second count. The two shut-off switches can represent three different states to supervise the consumption level of the consumable part.

Of course, employment of more shut-off switches allows the implementation of more levels of states.

The apparatus may be provided with a resistor provided on a consumable part which is loaded into the main body of the apparatus, a resistance-decision means disposed in the main body of the apparatus for deciding whether or not the resistance value of the resistor is within a tolerance and consumable part operation control means for setting the part operable when the resistance-decision means decides that the resistance value is within the tolerance.

FIG. 6A is a block diagram illustrating the relationship between elements of the consumable part of the apparatus of the present invention and a main body.

A consumable part 201 may be provided with not only a state setting means 202 for setting the states of the consumable part at a plurality of levels but also an abnormality detection means 203 for detecting the occurence of abnormal states about the consumable part and/or a distinguishing means 204 for distinguishing the consumable part from other consumable parts.

A main body 210 of the apparatus is provided with a count means 211 for counting the number of sheets of paper that have had an information storage operation performed thereon, and a state detection means 212 for detecting the state. Also, the storage apparatus may be provided with an external indication means 213, such as confirmation-indicating means, as a means for providing an external display and may incorporate a storage operation control means 215 as a means for controlling storage into a storage unit 214.

The outputs from the count means 211 and the state detection means 212 may be inputted to a life-time decision means 216 provided on the apparatus main body to decide the life-time of the consumable part. The output of the abnormality detection means 203 may also be used in deciding the life-time of the part. The main body of the apparatus may incorporate a normal-time consumable part processing decision means 218 for processing replacement of consumable part 201 in the normal state, and an abnormal-state consumable part processing decision means 219 for processing replacement of consumable part 201 in an abnormal state.

(1) Summary of Duplicator

Figure 6B:
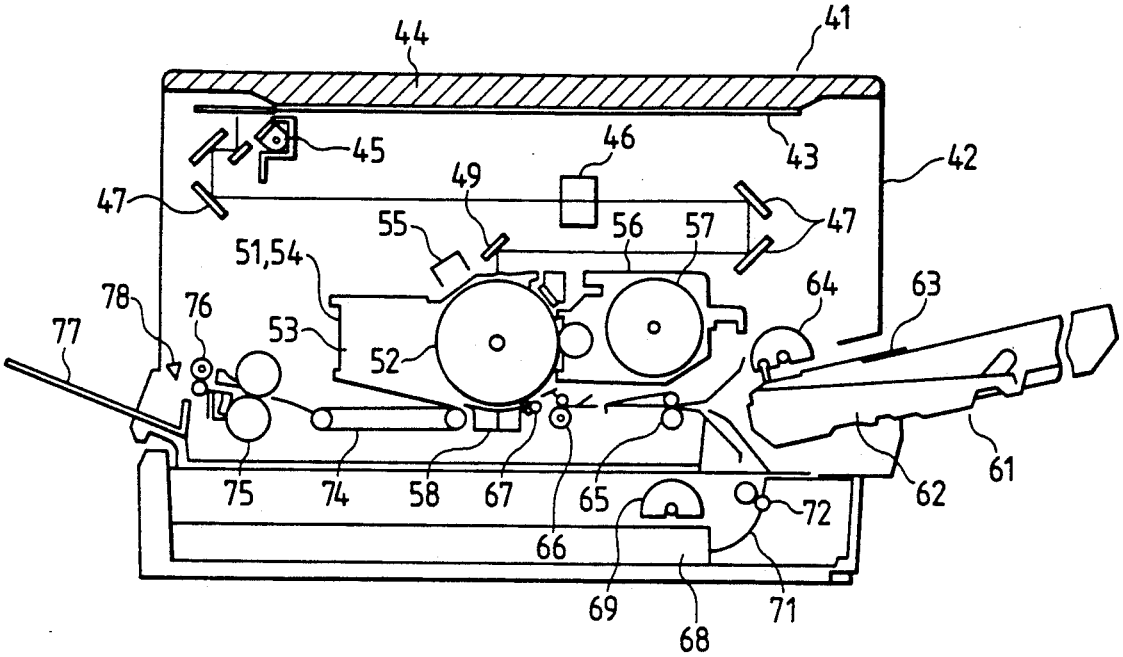
FIG. 6B illustrates a general arrangement of a duplicator according to a preferred embodiment of the present invention.

FIG. 6B illustrates a duplicator according to a preferred embodiment of the present invention. Duplicator 41 is provided with a glass platen 43 on apparatus main body 42. When copying a sheet-like document, a platen cover 44 is closed as shown in FIG. 6B to position the document in place. Below glass platen 43 is disposed a scanner, not shown, movable in a reciprocating motion. An optical lens 46 and a plurality of mirrors 47 as well as an exposure lamp 45. Reflected light from a document (not shown) illuminated by the exposure lamp 45 is incident upon a fixed mirror 49 via mirrors 47 and an optical lens 46. Then the light reaches a sensitive material drum 52 of a sensitive material cartridge 51 through an opening 112, which will be described later with reference to FIG. 7.

Sensitive material cartridge 51 corresponds to a consumable part according to a preferred embodiment of the present invention with a life-time supervised on the basis of the number of copies made. Sensitive material cartridge 51 is provided with a sensitive material drum 52 and a toner recovery device or sump 53, accommodated in an opaque housing 54, and is detachably disposed in the main body 42.

When the sensitive material cartridge 51 is mounted, a charge corotron 55, a developing machine 56, a toner cartridge 57, and a transfer/release unit 58 are disposed to surround the sensitive material drum 52. Although toner cartridge 57 is a type of consumable part, it is supervised in a different way from the sensitive material cartridge 51 and replacement thereof is done when a sensor (not shown) detects that the toner therein has been used up. This toner cartridge 57 is so separated from the sensitive material cartridge 51 that the toner cartridge 57 can be replaced many times until the toner sump device 53 is full of tone. Additionally, the toner cartridge 57 of a duplicator according to the invention contains color toner. Thus, color operation in red, green, and blue only requires replacement of the toner cartridge 57, which is easy to switch. Also, variety of color toners can be used at a relatively low cost.

The transfer/release unit 58 is formed of two corotrons, a transfer corotron and a detack corotron. A sheet of paper (not shown), which is advanced by a crescent feed roller 64 from a manual insertion shoot 63 mounted to serve as both a paper supply unit 62 of a cassette tray 61 and an upper lid of cassette tray 61, passes through a delivery roll 65 and a resist roll 66 and reaches a transfer-assist unit 67. A sheet of paper advanced by a crescent feed roll 69 from a paper supply unit 68 which is disposed below the apparatus main body 42, passes through a guide 71 and a delivery path roll 72 and reaches another delivery roll 65. Thereafter, the sheet of paper is delivered through the same routes as taken by paper from cassette tray 61 to transfer-assist unit 67. The auxiliary transfer-assist unit 67 is constructed of a driven roll that has an applied voltage of the same polarity as that of the transfer corotron. Consequently, even if the paper to which a toner image is transferred contains a large amount of moisture, charge supplied to the paper from the transfer corotron is prevented from leaking from the paper so that adequate transfer characteristics are ensured.

A toner image is transferred onto the paper that has passed the transfer-assist unit 67. The image is transferred from sensitive drum 52 with the aid of the transfer corotron disposed on this side of the transfer/release unit 58. The paper released by the detack corotron is delivered horizontally by a belt-like delivery path 74 to be heat-fixed by heat roll 75. Having been fixed, the paper is discharged to the outside of the duplicator by a takeup roll 76 and is stacked on a takeup tray 77. Immediately behind the takeup roll 76 is disposed a paper detection sensor 78 for detecting passage of the paper discharged onto the takeup tray 77 to count each sheet of paper.

Figure 6C:
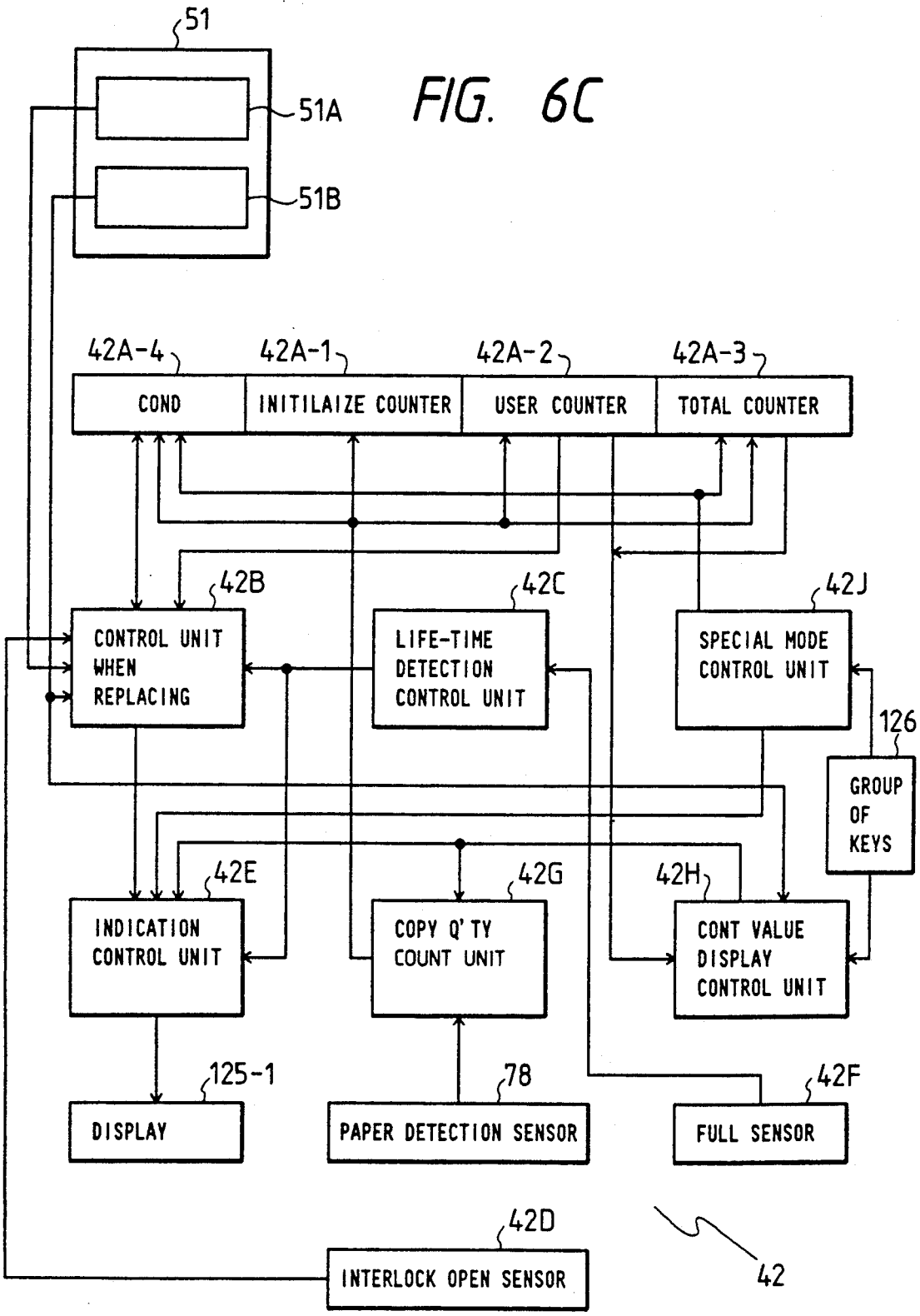
FIG. 6C is a functional block diagram showing various units of the duplicator shown in FIG. 6B.

FIG. 6C shows various units in a functional block diagram of the duplicator of the preferred embodiment of the present invention.

Sensitive cartridge 51 is a consumable part and is provided with a type unit 51A for outputting a type or state of sensitive cartridge 51 and a state unit 51B for outputting states of the sensitive cartridge 51. Apparatus main body 42 is provided with three counters corresponding to the state unit 51B, i.e., an initialize counter 42A-1, a user counter 42A-2, and a total counter 42A-3. When replacing sensitive material cartridge 51, a control unit 42B receives the outputs of a life-time detection control unit 42C for sensitive material cartridge 51, an interlock open sensor 42D, the type unit 51A, and the state unit 51B so that a cartridge replacement control operation can be performed. The control result is input not only to a state control unit 42A-4 for controlling the state of the respective counters 42A-1 to 42A-3 but also to an indication control unit 42E to control a 7-segment liquid crystal display 125-1, which will be described later.

Duplicator main body 42 is provided with a paper detection sensor 78 for detecting the time at which copied paper is discharged from the apparatus and a full sensor 42F for detecting whether sensitive cartridge 51 is full of recovered toner. The output of paper detection sensor 78 is input to a copy-quantity count unit 42G where count-up control of copy quantity is performed.

A control signal is supplied to an initialize counter 42A-1 and a user counter 42A-2 and also to a state control unit 42A-4 to control the state. The output of full sensor 42F is input to life-time detection control unit 42C to detect whether or not the life-time of the consumable part has expired when sensitive material cartridge 51 is full of the recovered toner. Life-time detection control unit 42C also detects the life-time of sensitive material cartridge 51 on the basis of the output of user counter 42A-2.

With the duplicator of the present preferred embodiment, the life-time of the sensitive material cartridge 51 is guaranteed in terms of the number of sheets of copies that can be made, thus it is very important for the users or maintenance personnel to know the count value. By operating a key group 126 disposed in a console panel which will be described later, a count value display control unit 42H is accessed to display the count values of user counter 42A-2 on the 7 segment liquid crystal display 125-1. Also, the embodiment is arranged in such a way that operating the key group 126 in a particular manner allows access to a special mode control unit 42J, through which a special mode is set up in which the initialize counter 42A-1 is cleared and total counter 42A-4 is controlled.

(2) Arrangement of the sensitive material cartridge

Figure 7:
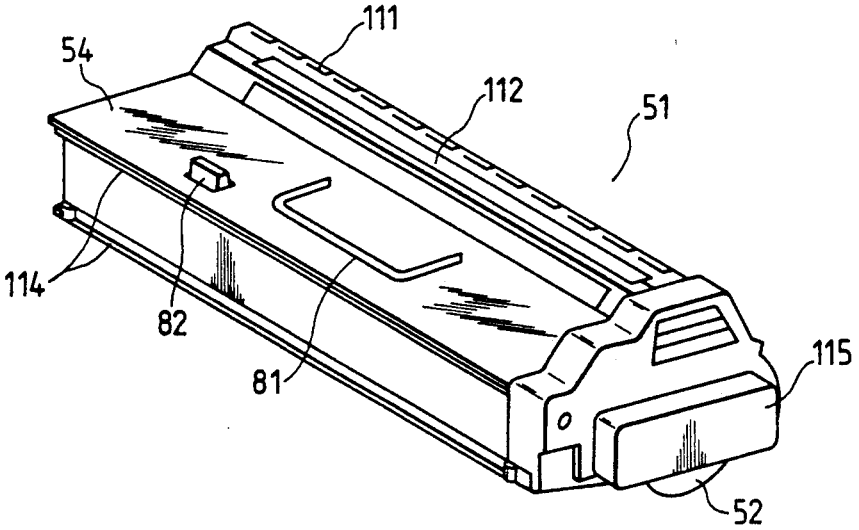
FIG. 7 is a perspective view of a sensitive material cartridge according to the preferred embodiment of the present invention.

FIG. 7 shows a perspective view of sensitive material cartridge 51. A hand grip 81 is mounted. On a black housing 54 of the sensitive material cartridge. Below the hand grip 81 is provided a cleaning device. In the vicinity of the hand grip 81 is disposed a transparent detection-strap cover 82 into which eventually projects a detection strap as toner is recovered in a sump device 53. Within the apparatus main body 42 is a light path which goes through detection cover 82. When this light path is blocked by the detection strap the sensitive material cartridge 51 is detected as being full of toner.

FIGS. 8 to 11 illustrate more specifically the operation of this presently preferred embodiment of the invention.

Toner sump device 53 is incorporated within the housing 54 together with the aforementioned sensitive material drum 52, a cleaning blade 84 for scraping off the toner image formed on the sensitive material drum 52, a toner receiving member 85, and a toner delivery member 86. Housing 54 is provided with toner receiving member 85 in the proximity to a toner-entering portion of a toner sump box 89 while also being arranged in a unit construction with the sensitive material drum 52, a cleaning blade 84 and a supporting portion of the toner delivery member 86. The toner delivery member 86 has a substantially square cross section and is adapted to rotate in the direction of an arrow. Additionally, a partitioning wall 87 is provided in a vertically suspending fashion from an upper wall of the sensitive material cartridge 51 to define the toner sump box 89. A toner scrape member 88 is a plate-like member secured at its one end to a partition wall 87 and scrapes off the toner deposited on toner delivery member 86.

A detection mechanism for detecting that toner sump device 53 is full of the recovered toner includes an optical sensor 91 positioned in the apparatus main body on both sides of detection strap cover 82 of sensitive material cartridge 51 so that detection strap cover 82 is sandwiched by sensor 91. Optical sensor 91 is formed of a light emitting element 92 and a light receiving element 93. Also, a float member 95 that moves up and down in accordance with the amount of toner 94 in the toner sump box 89 and a detection strap 96 provided in an upright position on float member 95 corresponding to detection strap cover 82 are disposed in sensitive material cartridge 51.

Figure 10:
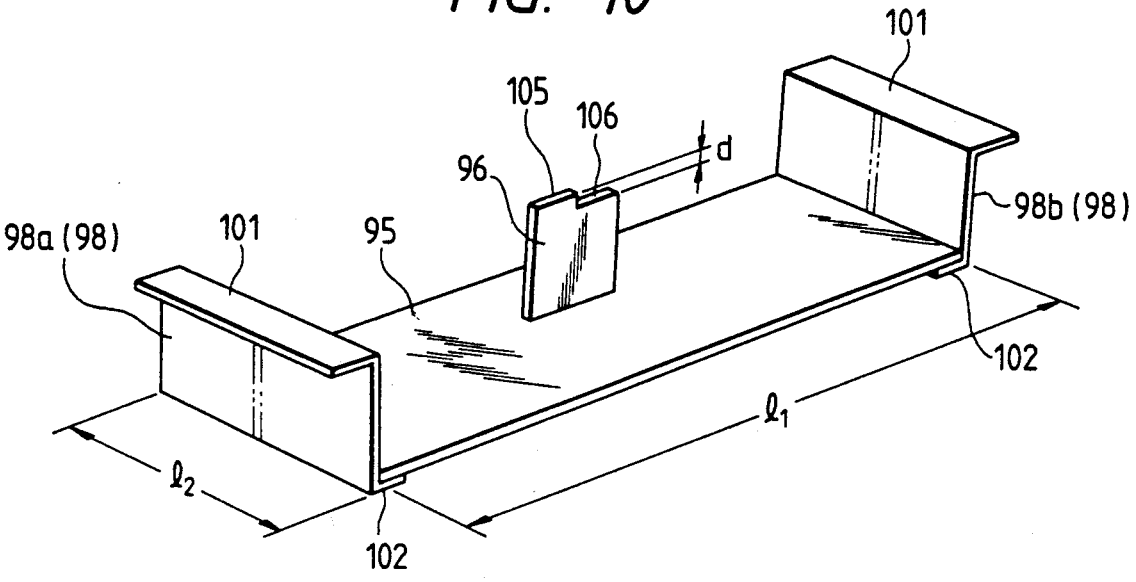
FIG. 10 is a perspective view of a relevant portion for illustrating a supporting mechanism of the float member of the present invention.
Figure 11:
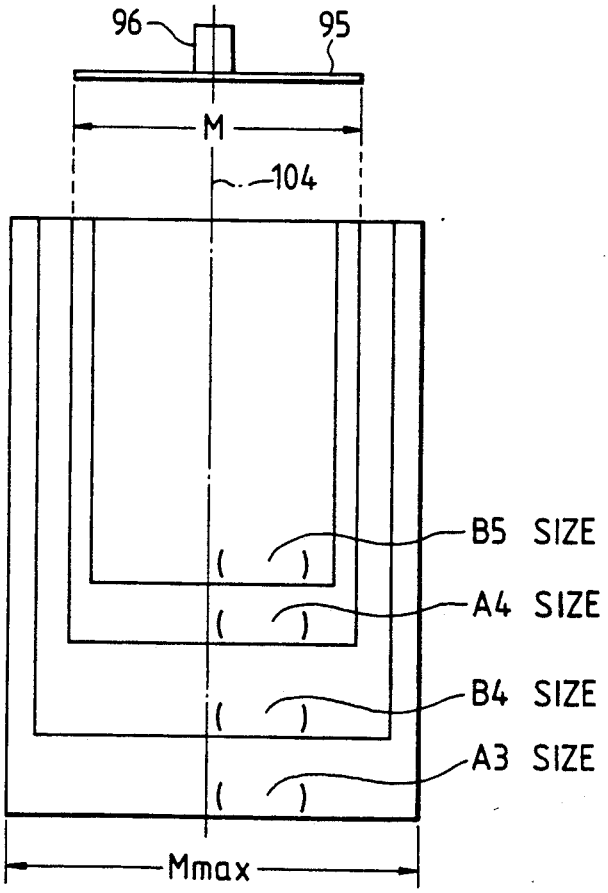
FIG. 11 is an illustrative diagram for showing the size of the float member and a position at which it is disposed.

Float member 95 is preferably formed of ABS resins or similar compounds, in the shape of a substantially rectangular plate as shown in FIGS. 10 and 11. Float member 95 is disposed in correspondence to a latent image formation area M (for example a region corresponding to a sheet of paper of a size 4 in a series A, Japanese Industry Standard) frequently used on the sensitive material. The longitudinal dimension 11 of the float member 95 is set in accordance with the paper size of A series No. 4 (referred to as A4 size hereafter) while the width-wise dimension $1_2$ (or the diameter of the sensitive material drum) of the float member 95 is set substantially in accordance with the dimension 1 of toner sump box 89. Float member 95 is supported by means of a flexible sheet 98 (specifically 98*a* and 98*b*) over toner sump box 89. Float member 95 is adapted to ascend and descend together with the flexible sheet 98.

In the preferred embodiment, the flexible sheet 98 is formed of, for example, a polyethylene tetraphthalate film or polypropylene film having thickness of 25 mm and has folded portions 101, 102 on the corresponding, respective upper and lower ends. Folded portion 101 is secured to the upper inner wall of the toner sump box 89 by means of a double-sided glued tape while the other folded portion 102 is secured to both longitudinal ends of the float member 95 in like manner.

Also, two types of optical sensors 91, formed of light emitting element 92 and light receiving element 93, are disposed in horizontal alignment. The detection strap 96 is provided at a position aliqned with a center line 104 (FIG. 11) of a latent image formation region M and is formed of an opaque black member such as ABS resin.

The tip end of the detection strap 96 is formed in the shape of steps and the distance to a higher step portion 105 is such that a light path of only one optical sensor 91*a* is blocked when the toner sump box 89 is nearly full of the recovered toner by the position of float member 95. The distance from higher step 105 to lower step 106 is so that a light path of another optical sensor 91*b* is blocked when the toner sump box 89 is full of the recovered toner.

Further, the dimension of the step "d" between higher step 105 and lower step 106 may be selected by taking into consideration a wide variety of conditions such as the ascending speeds of floating member 95 as it is pushed up in accordance with an amount of toner recovered in a single copy operation, copy speeds, and the amount of the recovered toner and monthly anticipated demand on the duplicator.

The above-described detection mechanism for detecting that the toner sump device is full of the recovered toner operates as follows.

Figure 8:
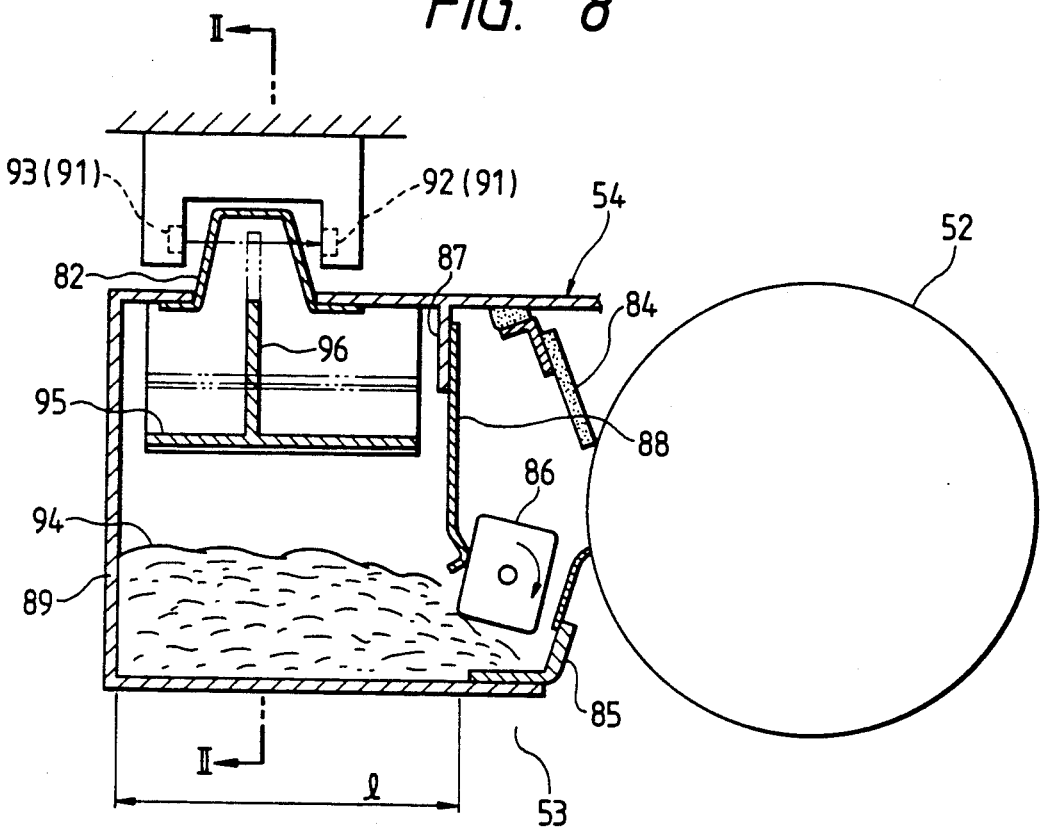
FIG. 8 is a cross-sectional view of a toner sump device.
Figure 9:
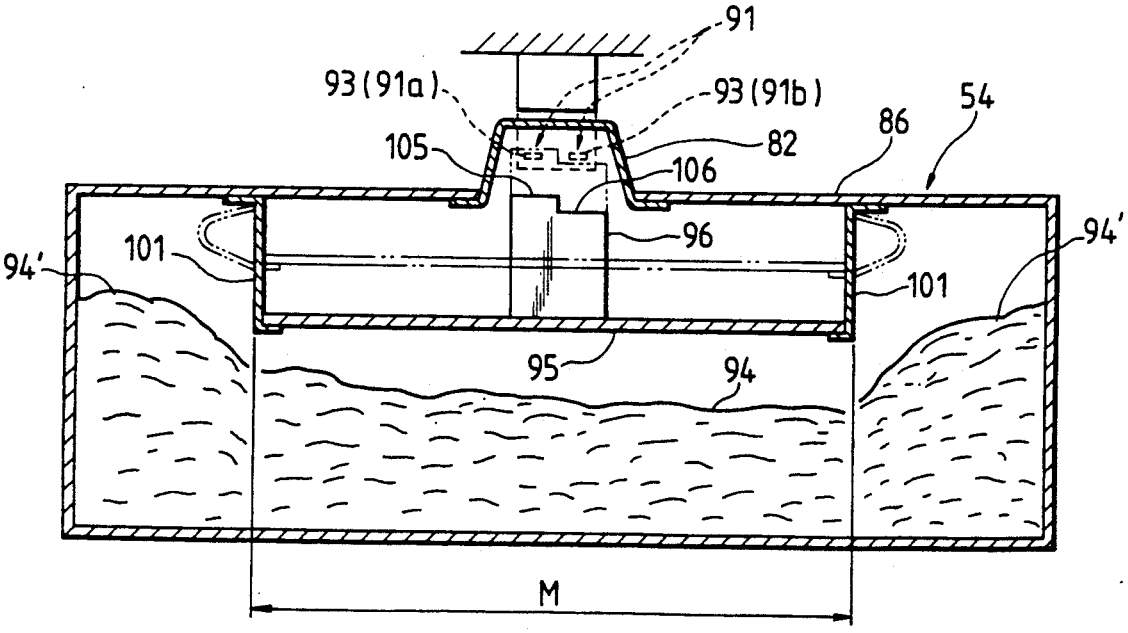
FIG. 9 is a cross-sectional view taken along line II—II of FIG. 8.

Assume that as shown in FIG. 8 and FIG. 9, the residual toner deposited on sensitive material drum 52 has been scraped off by cleaning blade 84 and dropped in toner receiving member 85. The toner on toner receiving member 85 will be recovered in toner sump box 89 through toner delivery member 86. At this time, the height of the toner in toner sump box 89 increases gradually and the top surface of toner 94 will contact with the lower surface of the float member 95 after a certain amount of time. Thereafter, as the amount of toner 94 increases, the float member 95 ascends following the toner 94 as shown in phantom in FIG. 8 and FIG. 9. Then the upper portion of strap 96 projects into transparent detection strap cover 82. Detection strap 96 continues to ascend as the toner pushes up float member 95 until higher step portion 105 blocks the light path one of the optical sensor 91*a*. Then the output of the optical sensor 91*a* varies from an H level to an L level causing an alarm lamp formed of light emitting diodes on the console panel (which will be described later) of duplicator main body 42 to light up, thereby alarming the operator that toner sump box 89 is becoming full of recovered toner.

Thereafter, when toner sump box 89 is full of the recovered toner due to further increase of the recovered toner, lower step 106 of the detection strap blocks the light path of the other optical sensor 91*b*. Then the output of optical sensor 91*b* changes from a H level (high level) to a L level (low level), so that duplicator main body 42 recognizes that sump box 89 is full of toner 94. With sump box 89 being full of toner, the alarm lamp that is formed of light emitting diodes on the console panel of duplicator main body 42 continues to light up, to inform the operator that sump box 89 is full of the recovered toner.

When sump box 89 becomes full, further copy operation is inhibited in the preferred embodiment of the invention. The inhibition of further operation prevents adverse effects in the cleaning process due to over-flow of toner 94 from toner sump box 89 causing staining of the inside of the duplicator or cleaning blade 84. Stray toner within toner sump box 89 may be deposited on the transparent inner wall of detection strap cover 82 during detection of the full condition of sump box 89. However, in such cases the optical sensor can be adjusted so that the zero level of the full-level detection signal is generated in step-wise fashion so that erroneous detection due to the deposited toner powder can be effectively prevented during operation.

In the case in which copy operation is performed on a given size of paper, e.g., A4 size, which is the most frequently used and is smaller than the maximum document size of the duplicator, an actual latent image formation region M on the sensitive material drum 52 is smaller than a maximum latent image formation region $M_{max}$. The duplicator of a preferred embodiment of the present invention does not have an erase device for removing an unwanted latent image on the sensitive material drum 52. Thus, when the copy operation is performed with a platen cover 44 shown in FIG. 6B opened, an area on the outside of the substantial latent image formation region M is developed as "black."

Figure 4:
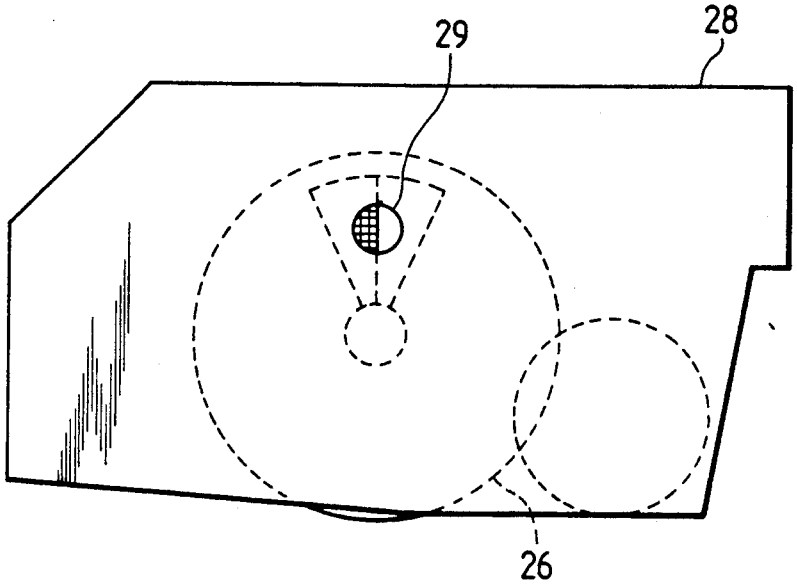
FIG. 4 is a plane view illustrating the portion of FIG. 2 mounted in place.
Figure 5:
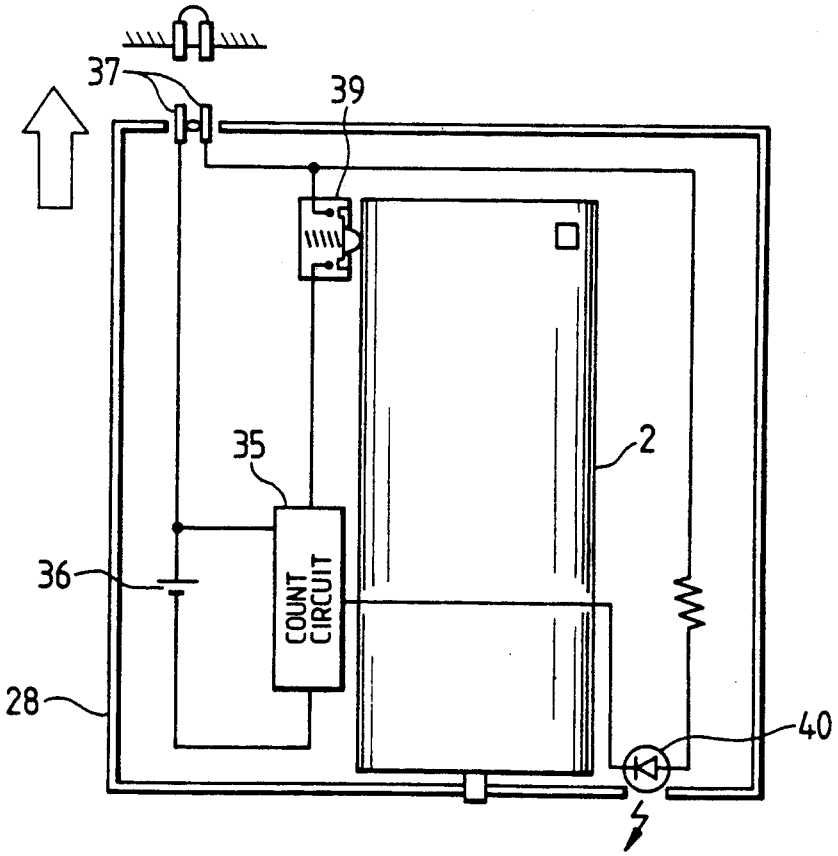
FIG. 5 is a diagram showing another example of a counter used in a duplicator apparatus.

In such a case, residual toner corresponding to this "black" is recovered in toner sump box 89. At this time, the amount of toner recovered on the outside of the latent image formation region M is greater than the toner recovered within region M. As a result, as shown in FIG. 4, the toner located on the outside of the region M 94' accumulates at a postition free of the suspended float member 95. However, the float member 95 is not positioned to contact toner outside of the latent image formation region M. Thus, float member 95 is not caused by recovered toner 94' to directly move up or to tilt extremely. Also, float member 95 is formed with a certain size with respect to the latent image formation region M. Even if non-uniform distribution of toner may occur locally in the region M, the weight of the float member 95 acts on toner 94 to cause the toner to spread out. The float member 95 moves up almost in parallel with the toner surface, following only the toner 94 corresponding to the substantial latent image formation region M, thereby accurately detecting the process to the "full condition."

Now referring to FIG. 7, description of sensitive material cartridge 51 will continue.

On the housing 54, to which the hand grip 81 is mounted, is positioned an elongate convex portion as illustrated in FIG. 7. Control grids 111 for the corotron are disposed in a line on top of the convex portion. With a conventional duplicator, a corotron wire is positioned in direct opposition to the sensitive material for charging. When the corotron wire deteriorates or the shield having a U-shaped cross section and disposed around the corotron wire becomes stained, the direction of flow of the charge flowing into the sensitive material changes as the the corotron wire tightens and an interruption tends to occur due to non-uniform charging. Since the corotron is provided with a grid disposed between the corotron wire and the sensitive material, the non-uniform charging cannot occur easily. The wire that applies a high voltage from the corotron is not shown but is normally disposed on the duplicator main body 42.

In the proximity of the control grid 111 for the corotron is disposed a slit-like opening 112. Light reflected by a fixed mirror 49 in FIG. 6B is incident on the interior of sensitive material cartridge 51 through opening 112 and will form a slit-like optical image at an exposure position (upper position of the sensitive material drum which is not shown) of sensitive material drum 52 which is partially exposed at the bottom of sensitive material cartridge 51 in FIG. 7. On the side of housing 54 of the sensitive material cartridge 51 are disposed two rails 114 which are used for mounting the sensitive material cartridge 51 to the duplicator main body 42 along a guide rail (not shown).

Figure 12:
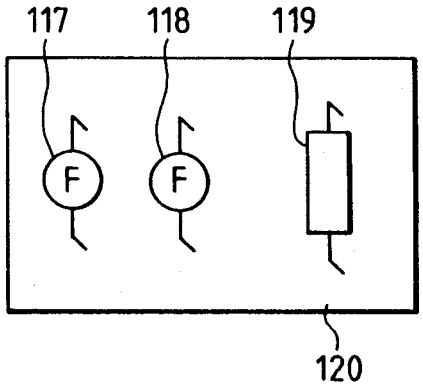
FIG. 12 shows a top view of an electrical circuit mounted to a board disposed in the sensitive material cartridge.

A lid-like member positioned on one side of sensitive material cartridge 51 shown in FIG. 7 is provided with a rectangular cover 115, on which a printed circuit board 120 having two fuses 117, 118 and a resistor 119 mounted thereon is disposed as shown in FIG. 12. The two fuses 117,118 are for setting the life-time of the sensitive material cartridge 51 and are connected to each other at one of the terminals (not shown). Fuses 117,118 need not be elements having the shape illustrated in FIG. 7 but may also be fuse elements in which a fuse material is fixed in polycarbonate resin. Using this type of fuse element will prevent improper connection across the fuse electrodes by means of other wires or the like since the fuse material is not exposed.

Depending on the state in which the two fuses 117, 118 are fused, the life-time of he sensitive material cartridge 51 "progresses" in corresponding steps. First, fuse 117 corresponds to the 99th copy and second fuse 118 corresponds to the 16000th copy after the first fuse 117 is fused. When second fuse 118 is fused, a "first life-time" of sensitive material cartridge 51 expires. Where the first life-time is the period of time during which the quality of cartridge 51 is guaranteed. When the quality of sensitive material drum 52 goes below a predetermined level or the copy operation is disabled due to the excessive toner recovered in cleaning device 53 shown in FIG. 6B, sensitive material cartridge 51 is to be replaced free of charge in order to practically guarantee the first life-time as will be described later. This assures the users of the benefits of the consumable part they bought.

When the life-time expires without problems occuring which require replacement of sensitive material cartridge 51, the duplicator will show an indication prompting replacement of sensitive material cartridge 51, but sensitive material cartridge 51 can still be used though quality is no longer guaranteed. An ultimate life-time expires at the 18000th copy so that 15% more copies can be made after the first fuse is fused. At the expiration of the ultimate life-time sensitive material cartridge 51 must be replaced before the copy operation can be continued. With respect to this ultimate life-time, a maximum of 98 sheets of extra copy is allowed. Thus, for example, when a copy operation completes at the 17999th sheet after first fuse 83 has been fused and subsequently a successive copy operation of a maximum 99 sheets can be commanded by the operator. This capability assures the operator of successive copy operation though one additional sheet of copy makes 18000th copy.

In this embodiment, two fuses 117,118 that can be fused by a small amount of current are used but the life-time supervision of the sensitive material cartridge 51 can be performed in multiple steps with corresponding multiple levels by using three or more fuses. Elements other than fuses can also be used as long as the elements can shut off a circuit against over-current or over-voltage or can change characteristic of the circuit in successive steps. These elements include semiconductor devices such as diodes and transistors.

Figure 13:
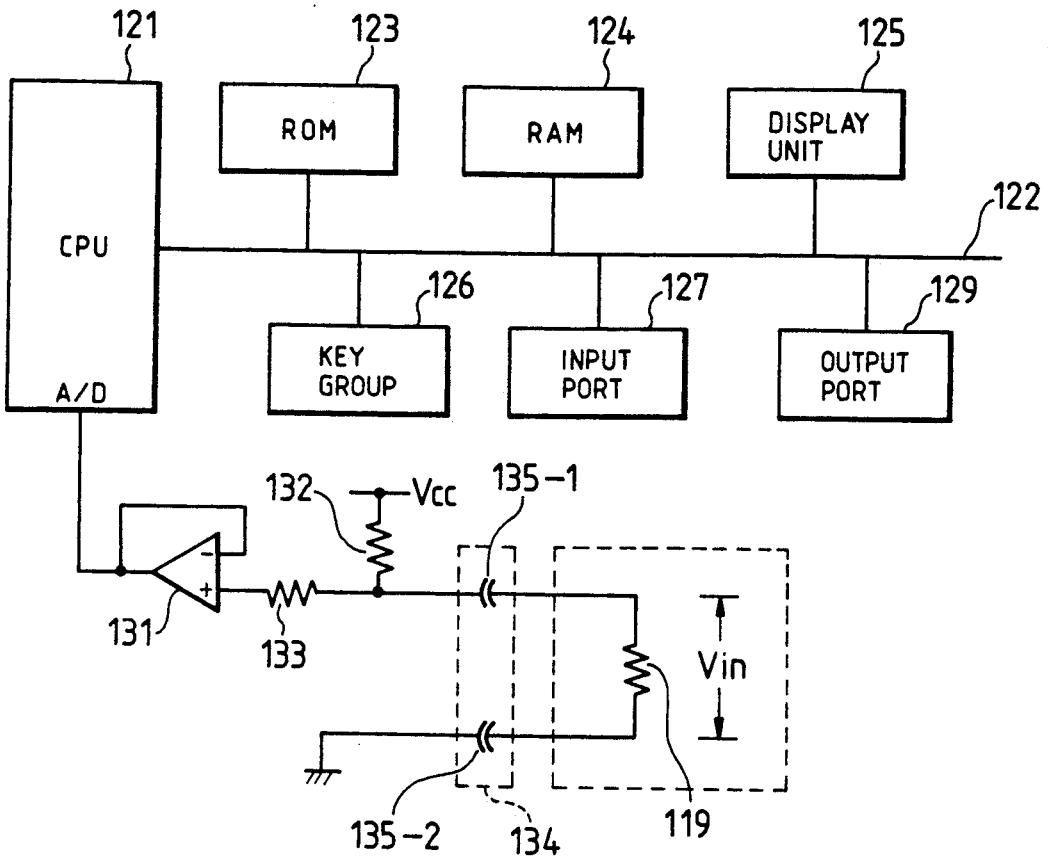
FIG. 13 is a block diagram for showing circuit arrangement of a control board on the apparatus main body to which 6-pin connector of the sensitive material cartridge is connected.

A 6-pin connector member 134 is disposed on the back side of sensitive material cartridge 51 of FIG. 7 (and illustrated in FIG. 13). This connector is used for transmitting to the apparatus main body a resistance value of a resistor 119, which has been set to a predetermined value for selectively supplying signals to set the life-time of sensitive material cartridge 51, or for deciding whether or not the sensitive material cartridge is correct for the apparatus.

(3) Distinguishing Sensitive Material Cartridge

Figure 14:
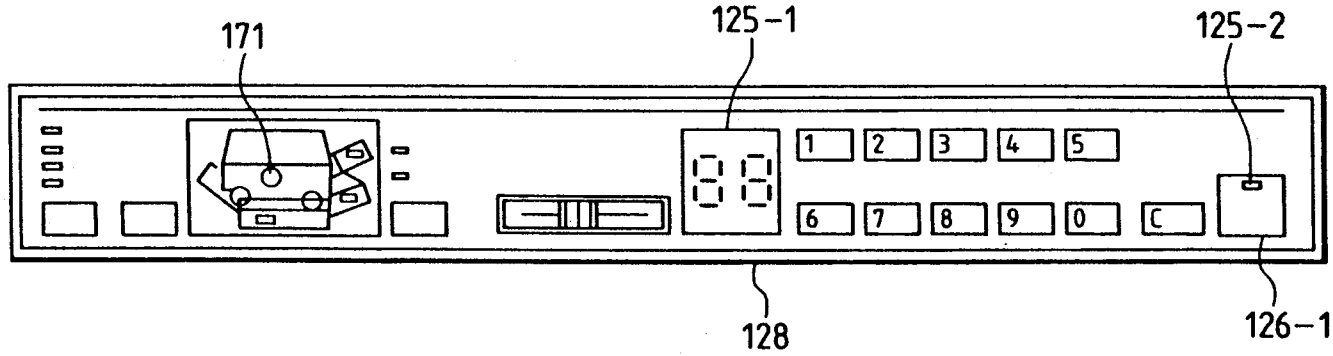
FIG. 14 is a top view of a console panel of the apparatus of the present invention.

Distinguishing of sensitive material cartridge 51 will now be described in more detail. FIG. 13 shows a circuit arrangement of the control printed circuit board on apparatus main body 42 to which board the 6-pin connector of the aforementioned sensitive cartridge 51 is connected. On this control circuit board is carried a one-chip CPU (central processing unit) 121. The CPU 121 is connected with the following units through a bus 122 such as a data bus:

(i) ROM123: a read only memory which stores various control programs which are executed by CPU 121;

(ii) RAM124: a random access memory for temporarily storing the respective data which is backed up by a battery;

(iii) Display 125: disposed on a console panel 128 shown in FIG. 14 and includes a ready lamp 125-2 and a 7-segment liquid crystal display 125-1 that can display two-digit numerical values or some letters, etc.;

(iv) a group of Keys 126: various types of keys such as a ten key switch disposed on console 128;

(v) Input port 127: a port for inputting detection signals from various sensors in the duplicator; and (vi) Output port 129: a port for outputting control signals to control various parts of the duplicator.

The output of a buffer amplifier 131 is connected to an analog/digital conversion input terminal (A/D) of CPU 121. A positive, "+", input terminal of buffer amplifier 131 is connected to one end of a series circuit of two resistors 132, 133. The other end of the series circuit is connected to a power supply $V_{cc}$. The node between resistors 132, 133 is connected to one end of a resistor 119 shown in FIG. 12 through one of the connections 135-1 of 6-pin connector 134. The other end of resistor 119 is grounded at main body 42 through the other connection 135-2 of 6-pin connector 134. Thus a voltage divided by resistor 119 and resistor 132 on the main body is input to buffer amplifier 131 through resistor 133.

Two pins of 6-pin connector 134 are connected to the aforementioned first and second fuses 117, 118, respectively, and the remaining two pins are connected with an erase lamp, not shown, disposed within sensitive material cartridge 51. The erase lamp is used for eliminating an unwanted part of the latent image formed on sensitive material drum 52.

A voltage $V_{in}$ divided by the resistor 119 and the resistor 132 is expressed as follows, $$V_{in} = \frac{V_{cc} \times R_{119}}{R_{119} + R_{132}}$$

where the resistances of resistors 119 and 132 are $R_{119}$ and $R_{132}$, respectively.

The CPU 121 compares the divided voltage $V_{in}$ with a voltage range that has been stored in the ROM 124.

Figure 15:
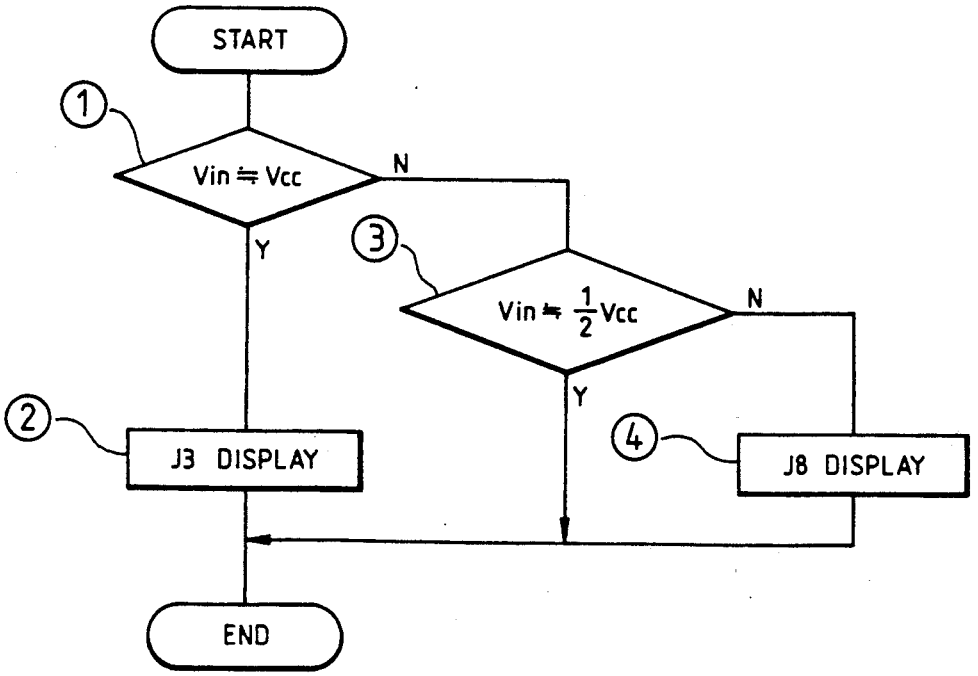
FIG. 15 is a flowchart for illustrating a method of identifying the correct sensitive material cartridge for a preferred embodiment of the invention.

FIG. 15 is a flow chart illustrating how these voltages are compared for distinguishing different sensitive material cartridge.

CPU 121 first decides whether or not the voltage $V_{in}$ is nearly equal to the supply voltage $V_{cc}$ (step 1). If they are almost equal (Y), then the 7-segment liquid crystal display 125-1 displays "J3" which represents that the resistance of resistor 119 is infinite. The occasions of displaying the display "J3" include when the sensitive material cartridge 51 is not loaded as well as when connection of connector 134 is not made due to loading of a non-specified cartridge.

If the voltage $V_{in}$ is not nearly equal to the $V_{cc}$ at step 1, then $V_{cc}$ and $V_{in}$ are compared to determine whether or not the voltage $V_{in}$ is nearly half of the supply voltage $V_{cc}$ (step 3). If $V_{in}$ is nearly half of $V_{cc}$ then resistances $R_{119}$,$R_{132}$ must be nearly equal, being set to 10 kohm, for example. If resistors 119, 132 are found to be nearly equal at step 3 (Y), then it means that a resistor 119 having a suitable value is mounted to sensitive material cartridge 51. In contrast to this, if the resistances are not nearly equal, it means that a cartridge suitable for other developing-methods or for other duplicator models may have been loaded by mistake, (N at step 3) the 7-segment display 125-1 displays "J8" (step 4). Thus, the operator is prompted to load the appropriate sensitive material cartridge 51 to duplicator main body 42 when the "J8" is displayed.

Figure 16:
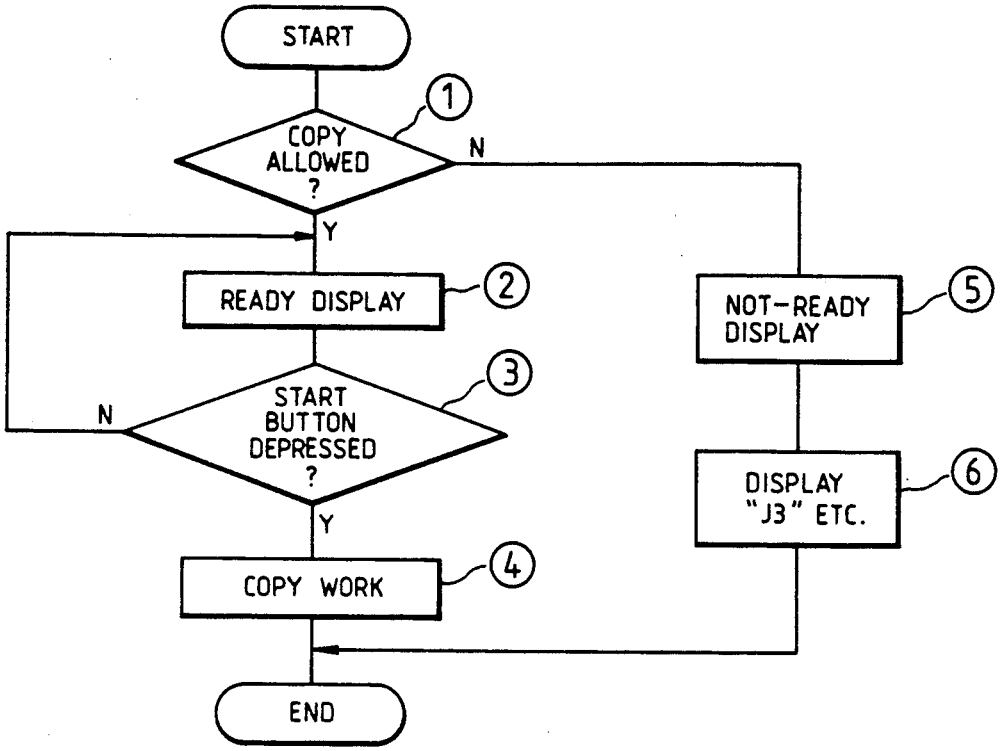
FIG. 16 is a flowchart showing the procedure for initiating the copy operation.

FIG. 16 illustrates associated operations when the copy operation is initiated.

CPU 121 monitors whether or not the copy operation can be initiated at the present state of the duplicator (step 1). If the duplicator is ready for copy operation, then a ready-display is activated (step 2). That is, a green ready-lamp 125-2 disposed on a start button 126-1 of the console panel lights up continuously. Then upon depression of start button 126-1 shown in FIG. 14 (Y at step 3), the copy operation is initiated (step 4). On the other hand, if the duplicator is not ready for copy operation (N at step 1), then the not-ready-display is activated so that the green ready-lamp flashes and a display representative of "please wait" is displayed (step 5) also the reason for the not ready condition, e.g., "J3" and "J8" etc., is displayed on 7-segment liquid crystal display 125-1 (step 6). In this case the copy operation is disabled.

Although the determination of whether the cartridge is or is not the right one utilizes resistor 119 in the duplicator according to the preferred embodiment of the present invention, similar control can be done by using other electrical elements or circuits to detect coincidence in characteristics.

(4) Fusing-control of fuse

Fusing-control of fuses 117,118 as a shut off switch provided on the sensitive material cartridge 51 will now be described in detail.

Figure 17:
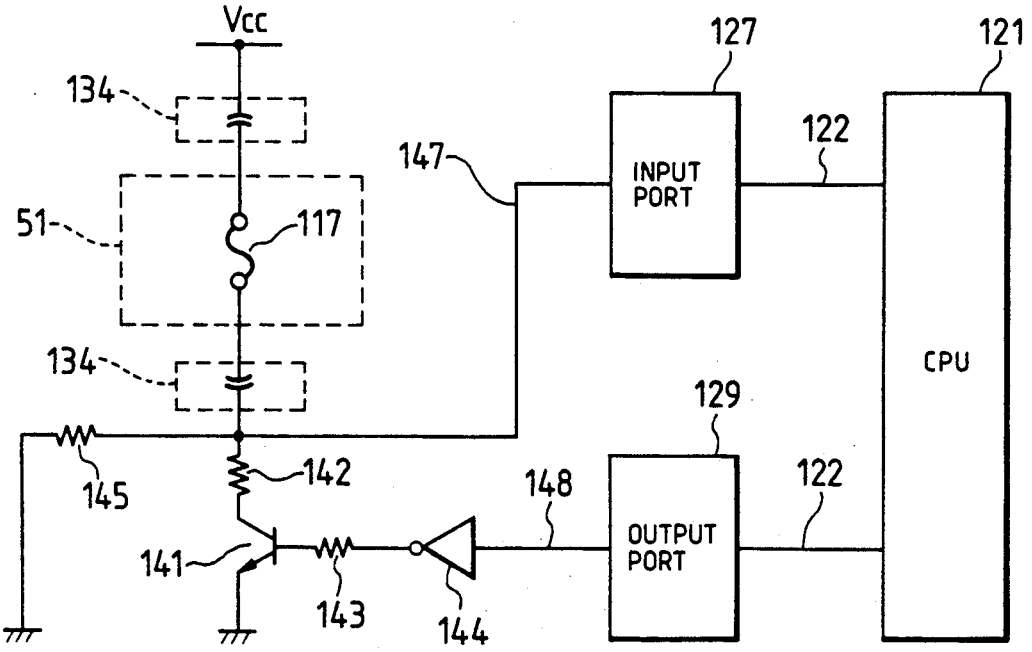
FIG. 17 is a circuit diagram of a circuit portion used in the preferred embodiment of the present invention to control the first fuse.

FIG. 17 shows a circuit portion related to the control of first fuse 117.

One end of first fuse 117 provided on sensitive cartridge 51 is connected to the supply voltage $V_{cc}$ supplied from apparatus main body 42 through 6-pin connector 134. The other end of first fuse 117 is connected to a resistor 142 of apparatus main body 42 through 6-pin connector 134. The emitter of a transistor 141 is grounded and the base thereof is connected to the output of an inverter 144 through another resistor 143. At the input of inverter 144 is connected output port 129 which in turn is connected with CPU 121 through the bus 122 as shown in FIG. 17. The collector of transistor 141 is connected to the resistor 142. The other end of resistor 142 is connected to input port 127 while also being grounded through a resistor 145. A cartridge state detection signal 147 is transmitted through a line between the collector of the transistor 141 and the input port 127 while a fuse short-circuit signal 148 is transmitted through a line between the output port 129 and the inverter 144.

This circuit will be described as follows.

The sensitive material cartridge 51 shown in FIG. 7 can be replaced by opening a cover of the duplicator (not shown) which shifts an interlock switch (not shown) to an OFF-position. In this way, the sensitive material cartridge 51 can be replaced and closing the cover allows the interlock switch to be switched to an ON-position. As shown in FIG. 18*a*, the power supply Vcc is turned on at a time $t_1$ at which time the main switch of the duplicator main body 42 is switched on, thereby causing a current to flow through fuses 117, 118; 6-pin connector 134; and resistor 145. First fuse 117 is of a current rating of several to several tens miliamperes and the resistor 145 is of a relatively high resistance so that a current sufficiently lower than this rating flows in relation to the power supply $V_{cc}$.

With first fuse 117 not being fused i.e., the sensitive material cartridge 51 is really brand new or less than 98 sheets of copy has been made from this cartridge, the collector of the transistor 141 is at a potential almost the same as the power supply $V_{cc}$. That is, the cartridge state detection signal 147 (FIG. 18*b*) is at the H level (high level) and CPU 121 is supplied with this data indicative of the state of sensitive material cartridge 51.

Figure 18:
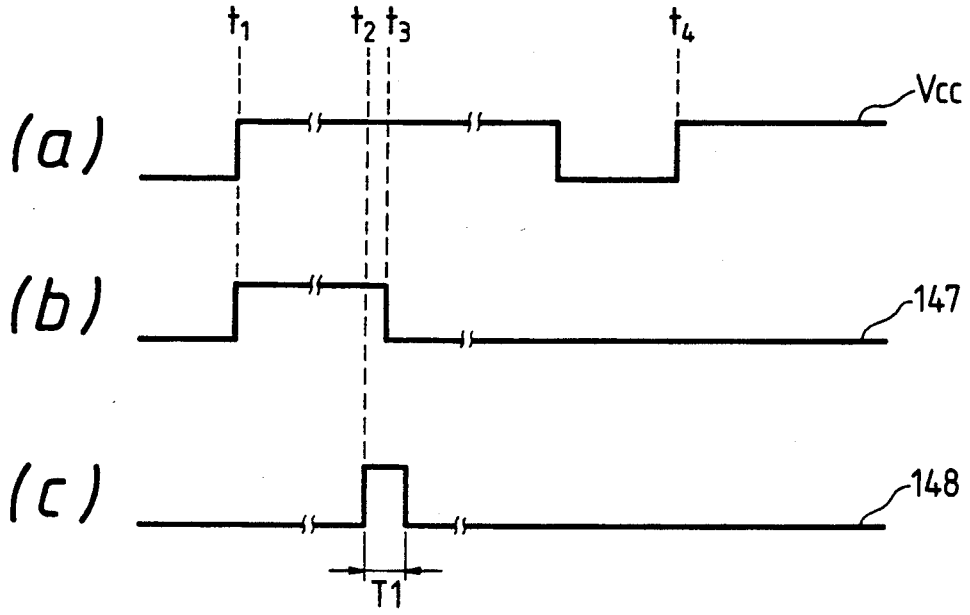
FIG. 18 is a timing diagram for illustrating the operation of the circuit shown in FIG. 17.

As the copy operation progresses and the 99th sheet of copy has been made from the new sensitive material cartridge 51 at a time $t_2$, CPU 121 performs a control operation for fusing the first fuse 117. That is, output port 129 provides the fuse short-circuit signal 148 (FIG. 18*c*) of duration T1 during which transistor 141 conducts. When transistor 141 is conducting, the first fuse 117 is grounded through the resistor 142. Resistor 142 has a relatively low value so that a relatively large current flows during period $T_1$, thereby causing first fuse 117 to fuse at time $t_3$. After time $t_3$, supply of $V_{cc}$ to the transistor 141 is terminated, thereby causing the cartridge state detection signal 147 to change to the L level (low level), as illustrated in FIG. 18(*b*).

Thereafter, the cartridge state detection signal 147 remains L level even when the interlock switch is ON again at a time $t_4$. Thus, CPU 121 can recognize that at least 99 sheets of copies have been made from a brand new cartridge 51. The circuit arrangement for first fuse 117 and operation leading to fusing thereof have been described thus far. Description of the circuit arrangement of second fuse 118 is omitted since it is similar to that of second fuse 117, except that fuse 118 fuses at 16000th sheet of copy after the first fuse 117 has been fused so that fuse 118 will fuse at the 98th sheet after the 16000th sheet.

Additionally, although the transistor 141 is caused to conduct by the fuse short-circuit signal 148 of a time duration of $T_1$ in this preferred embodiment of the present invention, fuse short-circuit signal 148 can be a continuous signal since the transistor 141 goes OFF if fuse 117 is fused. If a continuous signal is used, it is necessary to turn off fuse short-circuit signal 148 when sensitive material cartridge 51 is withdrawn. This prevents fuse 117 of a newly loaded sensitive material cartridge 51 from being forcibly fused by fuse short-circuit signal 148.

(5) Life-time control of sensitive material cartridge

As is apparent from the above description, the present invention employs first and second fuses 117,118 and the life-time is set in steps by fusing of the fuses. For this purpose, apparatus main body 42 is provided with two types of counters. The first counter is designated an initialize counter and a second counter is designated a user counter hereinafter. Duplicator main body 42 is provided with a counter called a total counter as in addition to the above two counters. These three counters are electronic counters and the counted values thereof are supposed to be stored in a RAM 124 as shown in FIG. 13. mRAM 124 is, therefore, backed up in two ways for ensuring reliability of the count valves, which will be described as follows.

(5-1) Back up control

Figure 19:
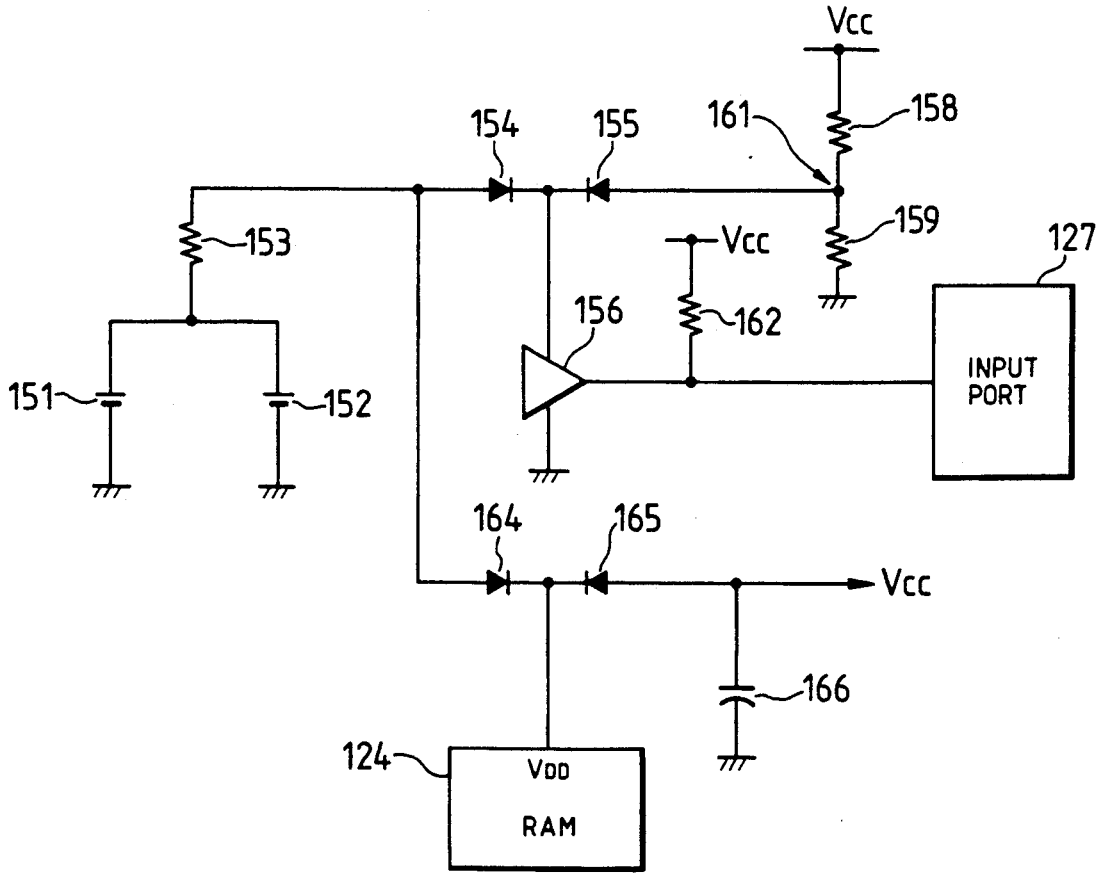
FIG. 19 is a circuit diagram representing a circuit portion for backing up the RAM of the present invention.

FIG. 19 illustrates a circuit portion for backing up RAM 124. Apparatus main body 42 is arranged to have two batteries 151,152 of identical characteristics incorporated. These batteries 151,152 are grounded at their "−" terminals and are connected in common to a resistor 153 at their "+" terminals. The other end of resistor 153 is connected to the anode of a first diode 154. The cathode of the first diode 155 is connected to the cathode of the second diode 155 as well as to a voltage detection circuit 156. The anode of the second diode 155 is connected with the midpoint of a series circuit of a resistor 158 and a resistor 159 which divides the voltage supply $V_{cc}$ for the duplicator main body 42. The output of the voltage detection circuit 156 is connected to the voltage supply $V_{cc}$ through a pull-up resistor 162 while also being connected to input port 127. Input port 127 is connected to CPU 121 shown in FIG. 13. Also, the other end of resistor 153 is connected with the anode of a third diode 164, the cathode of which is connected to the cathode of a fourth diode 165 and a power supply $V_{DD}$ for RAM 124.

The anode of fourth diode 165 is connected to $V_{cc}$ and a capacitor 166 for storing charge.

The maintenance such as replacement of the batteries 151,152 is performed by a service man. The operator is not allowed to perform such maintenance. When the voltages of these batteries decrease and approaches a minimum allowable value, the output of voltage detection circuit 156 is grounded but remains at a H level (high level), if the battery voltages are reasonably higher than the minumum allowable value. That is, the input port is supplied with a H level signal as long as the output voltage of batteries 151,152 are adequately high, but is supplied a L level (low level) signal if the voltage is less than the allowable value. When CPU 121 (FIG. 13) detects the L level (low level) signal, CPU 121 causes 7-segment liquid crystal display 125-1 (refer to FIG. 13) to display a specific symbol, thus promoting replacement of the batteries. The service man first replaces one of the two batteries 151,152 for a new one, thereby backing up RAM 124 even while replacement of the batteries is in progress.

With a circuit shown in FIG. 19 voltage detection circuit 156 formed of an integrated circuit is supplied with a power source from batteries 151,152 in the preferred embodiment of the present invention. If the voltage supplied from these batteries decreases below a certain voltage, then a malfunction may arise in voltage detection circuit 156. A voltage is produced at a voltage-dividing point 161 for ensuring a minimum level of operation of voltage detection circuit 156 by using the power supply $V_{cc}$ which is always present whenever the duplicator main body is operative. Thus when the voltages of both the batteries have decreased to an insufficient voltage and second diode 155 becomes ON, the output voltage failure of batteries 151, 152 is assured to be transmitted to CPU 121 with proper operation of voltage detection circuit 156. Low voltage produced at voltage dividing point 161 would prompt replacement of the battery only when the voltage of batteries 151, 152 is very low.

(5-2) Control of counter

Total counter 42A-3 is a counter which counts the total number of sheets of copies by being incremented every time the duplicator performs copy operation. Thus, the counter is necessarily incremented whenever the copies are discharged.

Initialize counter 42A-1 is a counter that counts up till the brand new sensitive material cartridge 51 has made the first 99 sheets of copies. User counter 42A-3 is a counter for counting the number of sheets after the first 99 sheets, and performs the counting operation so that users are guarenteed up to 16000 sheets of copies.

Initialize counter 42A-1 is adapted to count 99 sheets of copy before user counter 42A-2 performs its counting operations. When the service man performs maintenance, regular checkup, or repair work, the number of sheets of copies made by the service man is not to be counted together with the number of sheets of copies that the user makes. This arrangement is also necessary for factory-alignment before the duplicator is shipped out. If the service man or a factory workman uses a sensitive material cartridge that they brought from the factory for alignment of the duplicator, the first and second fuses of this cartridge will not be fused yet, so the duplicator will not allow the user counter to count up as long as the count value of the initialize counter is less than 99 sheets, thereby assuring the users of favorable service as will be mentioned later. Thus, the users can actually make extra sheets of copies as many as the count value of the initialize counter when they load a brand new sensitive material cartridge 51 rather than calling a serviceman. Further, this extra quantity of copy is prior to the 16000 sheets of copies that will be made by the user and is in addition to the 16000 sheets of copies and therefore can be thought of as a "bonus" to the user.

These counters take the form of electronic counters using memory devices because these counters can be configured at a cost lower than an electro-magnetic counter etc., and they do not require any specific space. The counting methods of the counters include a method in which user counter 42A-2 starts to count upon completion of counting by initialize counter 42A-1 as in the present embodiment and a method in which user counter 42A-2 and initialize counter 42A-1 start counting at the same time. The latter count method requires a switch circuit or selection circuit for selecting one of the two counters which leads to disadvantageous complexity of the entire counter arrangement.

Figure 20:
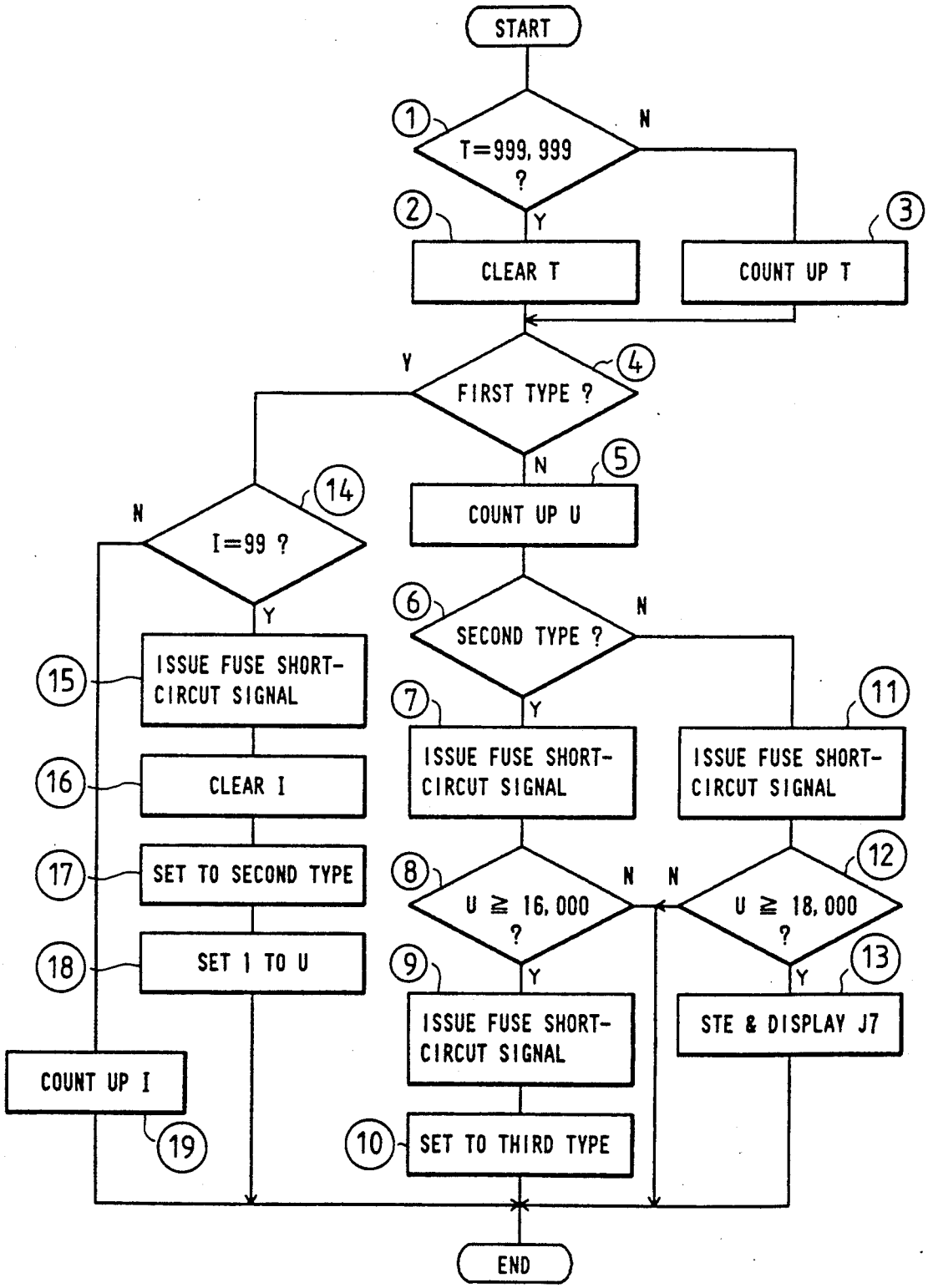
FIG. 20 is a flowchart for illustrating control of three types of counters provided on the duplicator main body of the invention.

FIG. 20 illustrates control of three types of counters provided on the duplicator main body. CPU 121 shown in FIG. 13 reads the count value T from the total counter and decides whether or not the counted value T is equal to 999999 (step 1). If T=999999 (Y), then the counter is cleared since it has counted its maximum value (step 2). If T is not 999999 (N at step 1), then the counter counts up by 1 when the paper is discharged by takeup roll 76 (FIG. 6B) to the outside of the duplicator (step 3).

Now, the total counter counts up at step 3, CPU 121 then decides whether or not the sensitive material cartridge is of a first type (step 4). In this preferred embodiment, the sensitive material cartridge can be classified as one of the following three types:

First type: first and second fuses 117, 118 have not been fused yet.

Second type: only first fuse 117 has been fused already.

Third type: both first and second fuses 117,118 have been fused already.

If the sensitive material cartridge is not the first type (N), then it should be the second type or the third type. In this case (N at step 4), it is considered that the 99 sheets of copies provided for initial alignment by the service man etc. have been made. Thus, the number of sheets that are available to the users with respect to that sensitive material cartridge is to be counted. Then the count U of user counter 42A-2 is incremented by "1" (step 5).

Thereafter, a decision is made based on whether or not the sensitive material cartridge that is loaded at present is the second type (step 6). If it is the second type (Y), then first fuse 117 must have been cut already. However, there is a possibility that first fuse 117 has not been cut for some reason. Thus, fuse short-circuit signal 148 of time duration of T1 is generated, as discussed with references to FIG. 17, to fuse first fuse 117 if it has not been sued yet. If first fuse 117 has already been fused, then no current will flow through it and nothing happens.

At the next step, CPU 121 reads the count value of the user counter to decide whether or not the count value is equal to or greater than 16000 (step 8). If it is equal to or greater than 16000 (Y), then the cartridge may be of the third type, in which case the fuse short-circuit signal is generated to the second fuse 118 for confirmation (step 9). Then the type of sensitive material cartridge 51 is set to the third type (step 10). If sensitive material cartridge 51 is not the second type (N at step 6), then the fuse short-circuit signal is generated to second fuse 118 for ensuring that the second fuse 118 has been fused (step 11). Then CPU 121 reads the count value of the user counter to make a decision based on whether or not the count value is equal to or greater than 18000 (step 12). If it is equal to or greater than 18000 (Y), then the life-time of sensitive material cartridge 51 expires and a flag "J7" is set at RAM 124 which causes 7-segment liquid crystal display 125-1 to display the flag (step 13), prompting the operator to replace sensitive material cartridge 51. Additionally, after the "J7" is displayed, further copy operation of the duplicator is inhibitted unless sensitive material cartridge 51 is replaced.

If the sensitive material cartridge 51 is found to be the first type in step 4, then a decision is made based on whether or not the count value I of the initialize counter is 99 (step 14). If I=99 (Y), then it is time to cut first fuse 117 thus the fuse short-circuit signal 148 of the time duration T1 is generated (step 15). Then the initialize counter is cleared so its count value is set to "0" (step 16). Since the type of the cartridge changes from the first type to the second type, this change is set at RAM 124 (step 17). Then the count U of user counter 42A-2 is set to "1" (step 18). If count I is not equal to 99 at step 14, initialize counter 42A-1 counts up by 1 normally (step 19).

(5-3) Control when replacing the cartridge

Next, control when replacing sensitive material cartridge 51 will be described as follows. Sensitive material cartridge 51 is assumed to be replaced in, for example, the following cases:

(i) When the user counter has counted 18000 sheets with respect to that sensitive material cartridge 51 to arrive at the end of the life-time thereof.

(ii) When the user counter has counted more than 16000 sheets with respect to that sensitive material cartridge so as to arrive at the end of the life-time that is guaranteed for that sensitive material cartridge and then a display for prompting replacement thereof is displayed.

(iii) When the service man visits for maintenance or regular checkups and performs maintenance operations etc. with the sensitive cartridge that he brought.

(iv) When the sump is detected to be full of the recovered toner before the cases (i) or (ii) happens with respect to the cartridge 51 so that the further copy operation cannot be carried on.

(v) When components that constitute sensitive material cartridge 51 become defective so that the further copy operation cannot be carried on or is not appropriate.

(vi) When sensitive material cartridge 51 of the aforementioned case (ii) is reused. Even if the sensitive material cartridge 51 is beyond the guarantee due to the fact that it is the one for which the user counter has counted more than 16000 sheets, the cartridge can still be used till the user counter counts up 18000 sheets as long as the sump does not become full of the recovered toner. Thus, this sensitive material cartridge 51 may be used for domestic use in the office etc. where picture quality if not of primary importance.

(vii) Replacement by mistake

This is, for example a case in which sensitive material cartridge 51 is replaced at the same time as toner cartridge 57 is replaced when copy color is to be changed.

Figure 21:
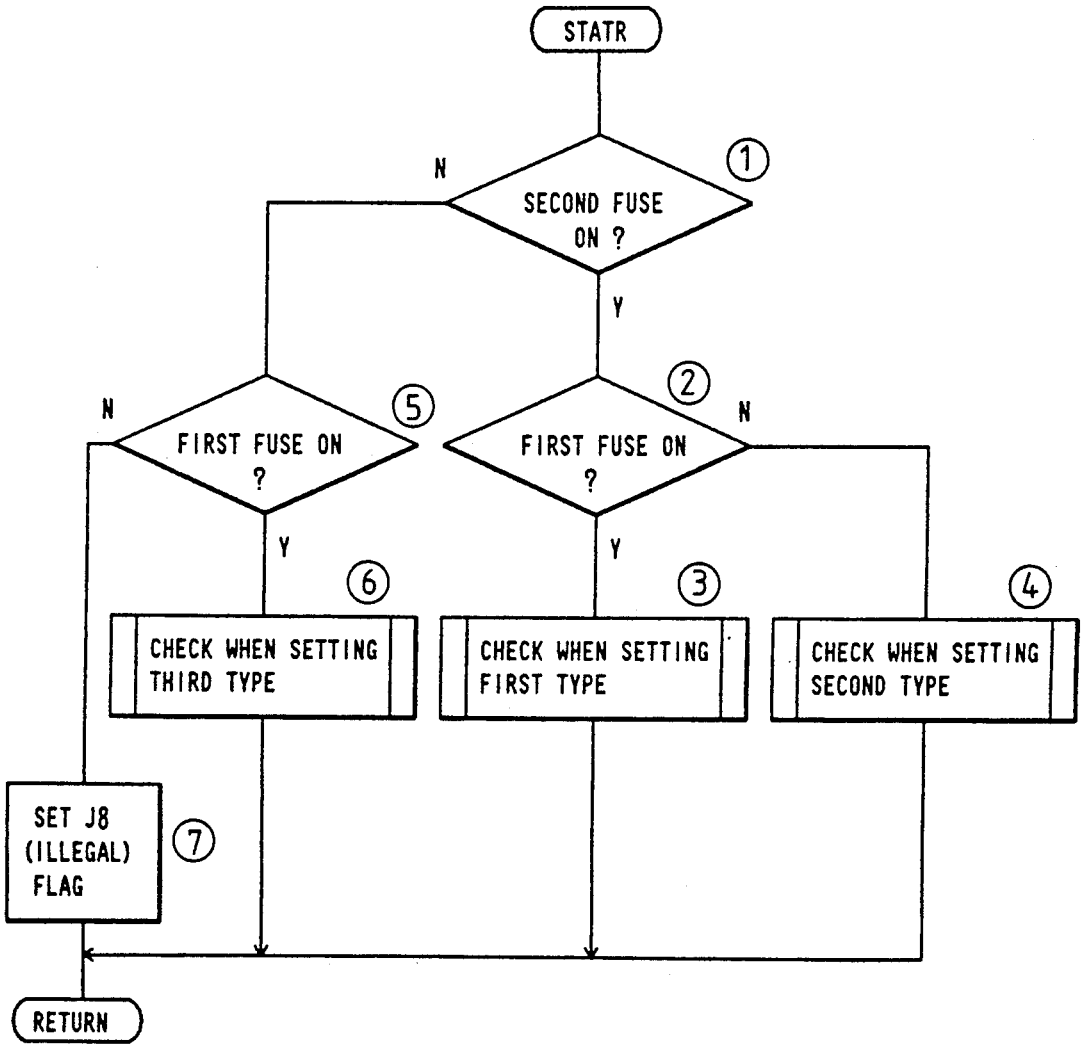
FIG. 21 is a flowchart illustrating a summary of control procedures when the sensitive material cartridge is replaced according to the preferred embodiment of the present invention.

FIG. 21 illustrates control summary when sensitive material cartridge 51 is replaced.

Replacement of sensitive material cartridge 51 can be detected by CPU 121 (FIG. 13) by detecting whether a pin of 6-pin connector 134 (FIG. 13) formed by a jumper line (not shown) is "ON" or "OFF. " After replacement of sensitive material cartridge 51 is detected, a change in collector potential of the transistor corresponding to the second fuse 118 is detected through input port 127 so that a decision is made based on whether or not fuse 118 is in a non-fused state (ON) or a fused state (OFF) (FIG. 16 step 1).

If second fuse 118 is ON (Y), then the sensitive material cartridge 51 currently loaded should be the first type or the second type. Then CPU 121 makes a decision based on whether or not first fuse 117 is ON (step 2). If the first fuse 117 is also ON (Y), then the check procedure, which will be described later in detail, for the case in which the cartridge loaded is the first type is executed (step 3). If the first fuse 117 is OFF (N at step 2), then the check procedure, which will be described later in detail, for the case in which the cartridge 51 is the second type is executed (step 4).

If the second fuse is decided to be OFF at step 1 (N), then a further decision is made based on whether or not first fuse 117 is ON (step 5). If first fuse 117 is also OFF (Y), then the check procedure, which will be described later in detail, for the case in which the cartridge is the third type (step 6). On the other hand, if first fuse 117 is ON, the type of the cartridge cannot be assumed logically. Thus, the flag "J8" indicative of an illegal condition is set in a predetermined area of the RAM 124 (step 7). As mentioned with reference to FIG. 15, the "J8" flag is also set when the resistance of resistor 119 of sensitive material cartridge 51 is not a specified value, prompting replacement of sensitive material cartridge 51.

Figure 22:
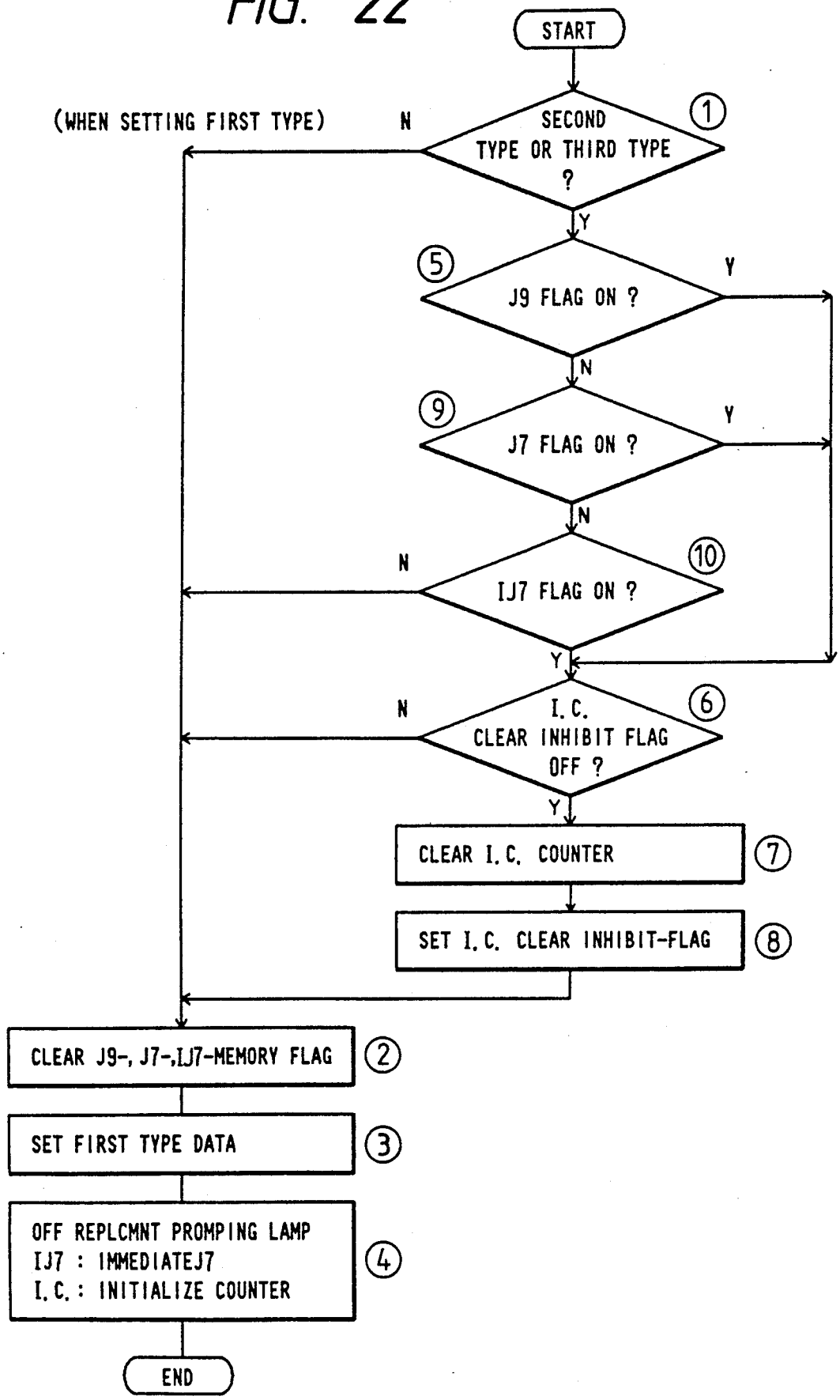
FIG. 22 is a flowchart for illustrating the check procedure, of FIG. 21 for loading the first type sensitive material cartridge 51.

FIG. 22 shows a decision procedure when the sensitive material cartridge of the first type shown at step 3 in FIG. 21 is set.

First of all, CPU 121 reads data related to the previous type of sensitive material cartridge 51 from RAM 124 to make a decision based on whether or not the previous sensitive material cartridge 51 was the second type or the third type (step 1). As a result, if the previously set sensitive material cartridge 51 is neither the second nor the third type (N), then the procedure proceeds to step 2 where flags are cleared. Then at step 3, the cartridge type data is reset to the first type as a result of the decision process after replacement.

On the other hand, if sensitive material cartridge 51 before replacement is the first type (Y at step 1), a decision is made based on whether or not flag "J9" in RAM 124 has been set ON (step 5). If the flag "J9" has been ON (Y), then this flag indicates that the sump has been full of the recovered toner despite the fact that the count value of user counter 42A-2 is less than 16000. Thus, sensitive material cartridge 51 has become unusuable before the guaranteed number of sheets of copies was arrived at, and it is therefore a case in which exchange for a brand new cartridge, refund depending on level of usage, or option of purchasing a brand new cartridge at a discount price should be exercised. In any case, a new cartridge 51 has been loaded. In this case if the clear inhibit flag of the initialize counter is OFF (Y at step 6), then the content of the initialize counter is cleared (step 7), then the "J9" flag is cleared (step 2) after a flag for inhibiting re-clear of the counter is set (step 8), and then at step 3 the type data is reset to indicate that the cartridge is the first type. Thereafter, the replacement-promting lamp 171 (FIG. 9) is set to turn off (step 4). If the clear inhibit flag is ON (N at step 6), then the procedure enters step 2 rather than proceeding to step 9.

Additionally, the replacement prompting lamp 171 is a yellow-light emitting diode which flashes when the user counter has counted up more than 16000 sheets, and lights up continuously upon one of the following conditions occurrinq after the count value reaches 18000 sheets or the sump is detected to be full of the recovered toner:

(i) When the required number of sheets have been copied and a series of copy operations (copy cycle) is completed.

(ii) When the duplicator is powered on, or when the interlock circuit becomes closed upon closing the once opened cover etc., not shown, of duplicator main body 42.

At step 5 in FIG. 22, a decision is made based on whether or not the "J7" flag has been set ON (step 9) if the "J9" flag is not ON.

The "J7" flag corresponds to one of the following cases:

(i) When the user counter has counted up more than 18000; and (ii) When sump is full of the recovered toner and the user counter has counted more than 16000 but less than 18000.

If the "J7" flag is ON (Y), the procedure proceeds to step 6, and if the clear inhibit of the initialize counter is set or OFF (Y), then the initialize counter is cleared (step 7). Then after a flag for inhibiting re-clear is set (step 8), the "J7" flag is cleared (step 2). Then at step 3, the type data is reset to a value indicative of the first type of sensitive material cartridge 51 and replacement prompting lamp 171 (FIG. 9) is set to turn off (step 4) if it is on or flashing on and off.

At step 9 in FIG. 22, if the "J7" flag is not ON (N), then a decision is made based on whether or not "immediate J7 (IJ7)" flag is ON (step 10). The "immediate J7" flag is set ON when the user counter indicates a count value less than 16000 while at the same time the sensitive material cartridge 51 is changed from the first type or the second type to the third type. If the "immediate J7" flag is ON (Y), the procedure proceeds to step 6 to clear the initialize counter as required and then the "immediate J7" flag is cleared (step 2).

Also at step 10, if the "immediate J7" flag is not ON, then the procedure will simply proceed to step 2.

Table I below summarizes the above-mentioned "J" codes.

TABLE I

| J code | Description |
|---|---|
| J3 | *The sensitive material cartridge 51 is not loaded<br>*Connector is not connected |
| J7 | *Replacement of the cartridge is prompted |
| J8 | *Wrong sensitive material cartridge 51 is loaded |
| J9 | *Replacement of the sensitive material cartridge is prompted since the sump is full of the toner while the user counter has counted less than 16000 sheets |
| Immediate J7 | *When the sensitive material cartridge 51 of the first type or the second type is replaced by the third type with the user counter having counted less than 16000 sheets |

Figure 23:
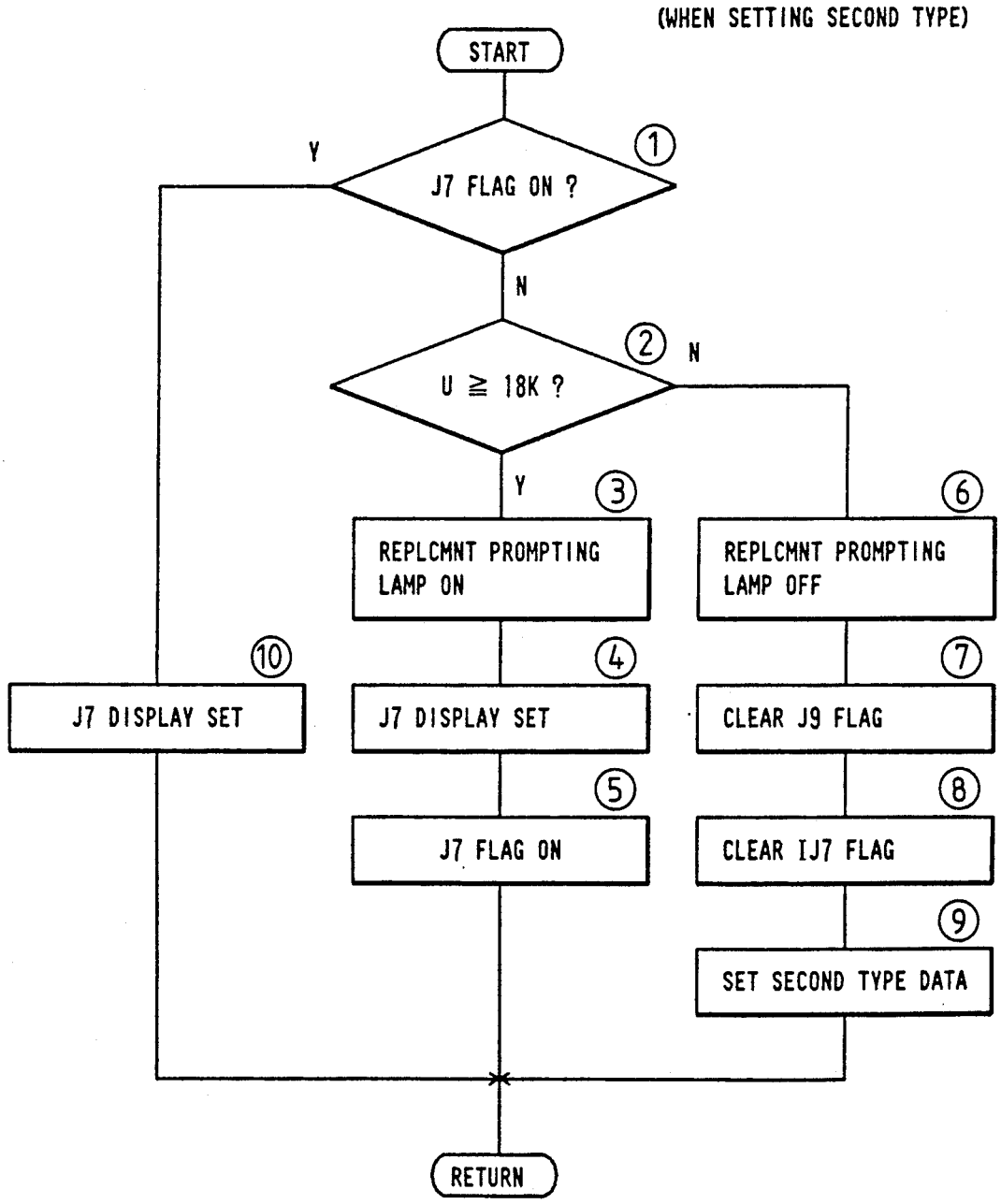
FIG. 23 is a flowchart for illustrating the check procedure, of FIG. 21 for loading the second type sensitive material cartridge.

FIG. 23 illustrates a decision procedure when the sensitive material cartridge of the second type is loaded shown at step 4 in FIG. 21 and must be checked.

When the second type sensitive material cartridge 51 is loaded, CPU 121 first makes a decision based on whether or not the "J7" flag is ON (step 1). If the "J7" flag is OFF (N at step 1), a decision is made based on whether or not the user counter indicates a count value greater than 18000 (step 2). This is so arranged for the following reasons. That is, since even if the "J7" flag has been ON, it becomes OFF when a new sensitive material cartridge 51 is loaded into the duplicator main body 42. Thus, taking into account a case in which an old type sensitive material cartridge 51 may possibly be loaded after this flag becomes OFF, the user counter is arranged to be interrogated as to its count value. Therefore, if the user counter is decided to have counted more than 18000 at step 2 (Y), the replacement prompting lamp 171 (FIG. 9) of sensitive material cartridge 51 is caused to light up (step 3), and the "J7" flag is set ON again (step 5) after the 7-segment liquid display 125-1 is caused to display "J7" (step 4).

Contrary, if the user counter is decided to have counted less than 18000 at step 2, then the replacement prompting lamp 171 is turned off (step 6). Then the "J9" flag is cleared (step 7). Also, "immediate J7" flag is cleared (step 8), then the type data is reset to a data value indicative of the second type (step 9).

If the "J7" flag is ON at step 1 (Y), then 7-segment liquid display 125-1 is caused to display the "J7" (step 10). This is because replacement of the sensitive material cartridge only to the first type is allowed in this case.

Figure 24:
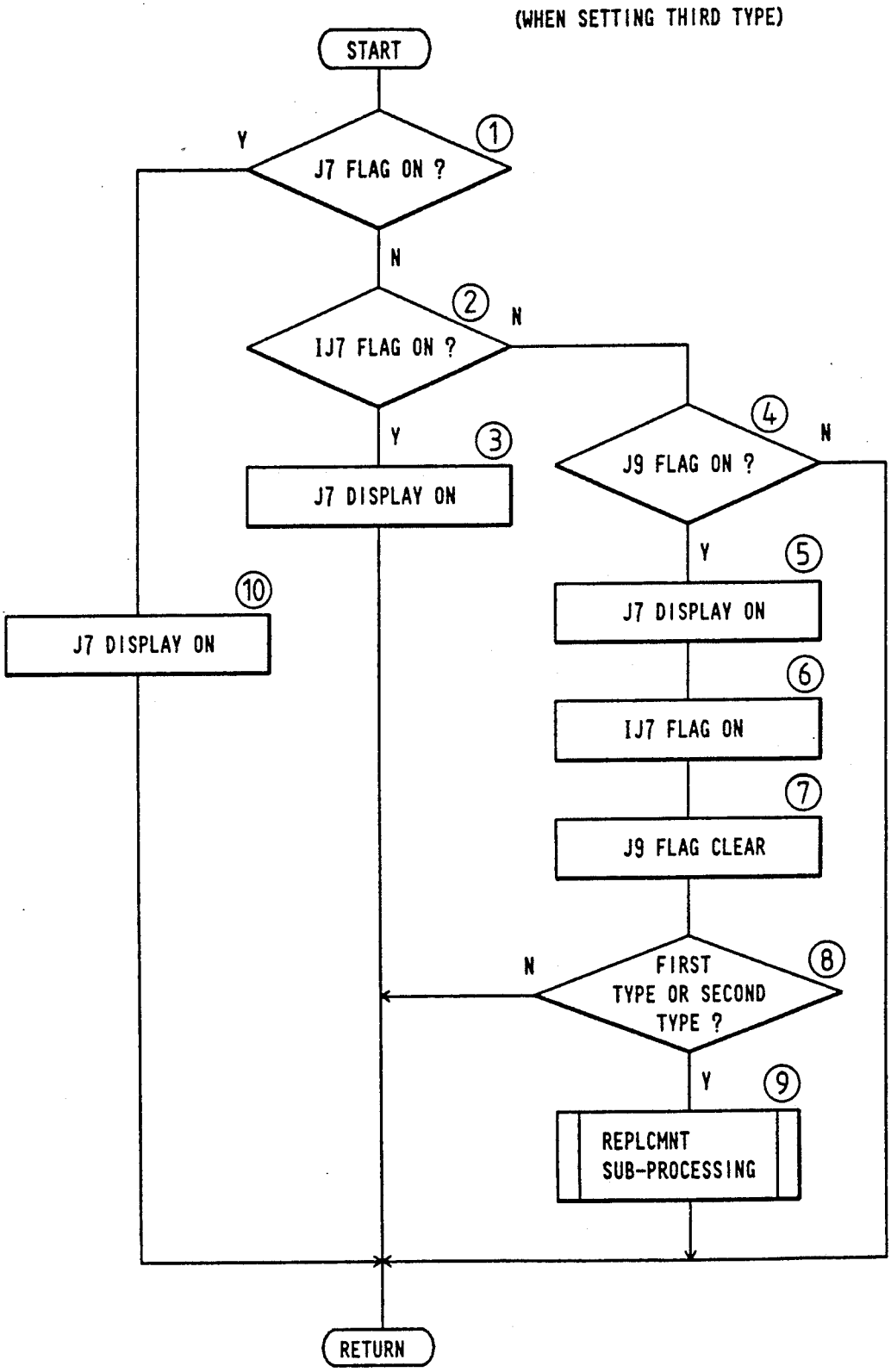
FIG. 24 is a flowchart for illustrating the check procedure of FIG. 21 for loading the third type sensitive material cartridge.

FIG. 24 shows decision procedure when the sensitive material cartridge of the third type is loaded as shown at step 6 in FIG. 21 is set.

CPU 121 first makes a decision based on whether or not the "J7" flag is ON (step 1) when the loaded sensitive material cartridge 51 is indicated to be of the third type.

If the "J7" flag is OFF (N at step 1), a decision is made based on whether or not the "immediate J7" flag is ON (step 2). If this flag is ON (Y), then despite the fact that the user counter indicates the count value less than 16000, it is understood that a sensitive cartridge 51 of the third type is indicative of a count value greater than 16000. Then life-time supervision with respect to the sensitive material cartridge 51 loaded cannot be carried out and thus CPU 121 causes the "J7" display to be ON (step 3), thereby requesting replacement of the newly loaded sensitive material cartridge 51, then the process is complete.

Figure 25:
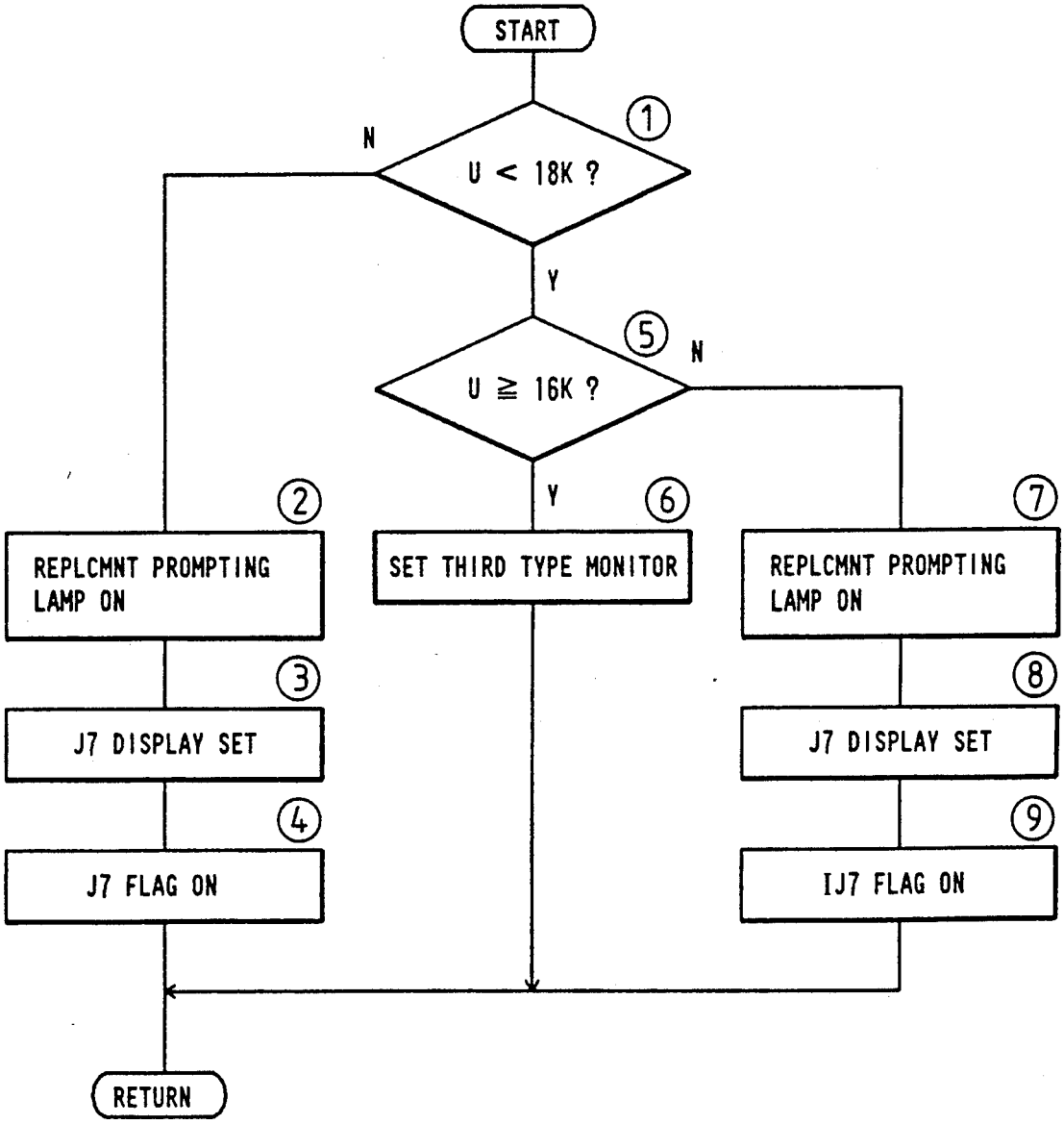
FIG. 25 is a flow chart of replacement subprocessing according to the preferred embodiemnt of the present invention.

In the meantime, at step 2, if "immediate J7" flag is decided to be OFF, then a decision is made based on whether or not the "J9" flag is ON (step 4). If the "J9" flag is ON, then it indicates that the sump has become full of the recovered toner while the count value of the user counter is less than 16000. Thus, in this case, the "J7" display is set ON (step 5). At the same time, "immediate J7" flag is set ON (step 6) and the "J9" flag is cleared (step 7). Then the previously loaded sensitive material cartridge 51 is the first or the second type, subprocess for replacement illustrated in FIG. 25 is carried out (step 9). If the "J7" flag is ON (Y), then the "J7" display is displayed (step 10) and the process is complete. This is for the same reason as described at step 1 in FIG. 23.

FIG. 25 illustrates the content of the replacement subprocess.

In this case, CPU 121 makes a decision based on whether or not the count value of the user counter is less than 18000 (step 1). If it is greater than 18000 (N), then replacement prompting lamp 171 is caused to be ON (step 2) since this sensitive material cartridge 51 cannot be used. Also, after the 7-segment liquid crystals display 125-1 is set to display (step 3) "J7" the corresponding flag is set ON (step 4).

However, if the count value of the user counter is less than 18000, then a decision is made based on whether or not the count value is greater than 16000 (step 5). If it is greater than 16000 (Y), then the type data is reset to a data value indicative of the third type of sensitive material cartridge 51 (step 6). If the count value of the user counter is less than 16000 (N at step 5), then "J9", indicative of that the sump is full of the recovered toner, can be assumed. Thus, the replacement prompting lamp 171 is turned ON (step 7), then 7-segment liquid crystal display 125-1 is caused to display the "J7" (step 8), thereafter "immediate J7" flag will be ON (step 9).

A case in which various types of cartridge are replaced will be described. These are specific explanations about control within the respective flowcharts described previously.

(5-4-1) Normal replacement processing, i.e., no J-displays or flags.

FIG. 26 illustrates a case in which the sensitive material cartridge 51, which is a CRU (Customer Replaceable Unit), is replaced with the duplicator not displaying the aforementioned "J7", "J9", or "immediate J7". Such a case is rather difficult to assume, replacement may be carried out because of a misunderstandinq but even so quality warranty of sensitive material cartridge 51 and benefit for both the users and cartridge suppliers should be balanced.

In FIG. 26, "OLD - - - NEW" at the left column is indicative of the previous type of sensitive material cartridge 51 (OLD) and the type of the replacement cartridge loaded (NEW), "T1" below it represents the first type of sensitive material cartridge 51, T2 the second type, and T3 the third type, respectively.

(A) A case in which replacement is performed from the first type to the first type will be described as follows. This case includes, for example, a case i which the same sensitive material cartridge 51 once taken out is loaded again, the initialize counter will continue to count from the count value before the cartridge is replaced. Thus, assuming that the count value of the initialize counter when replacing is 99 sheets, one sheet of copy will cause transition from the first type to the second type.

In this case, too, the users are of course guaranteed 16000 sheets of copies, resulting in no unfavorable effects to the users. When replacement is performed from the first type to the first type, the count value of the new sensitive material cartridge after replacement is indicative of the first type thus the user counter itself does not start counting.

(B) A case in which replacement is performed from the first type to the second type.

(i) If the count value of the user counter is less than 16000, then it matches the range of the count value of the currently loaded second type sensitive material cartridge 51. Thus, the cartridge is suitable in this case, and the user counter continues counting.

(ii) Next, a case in which the count value of the user counter is greater than 16000 but less than 18000 will be described.

In this case, the number of the copies made from the loaded sensitive material cartridge 51 is less than this count value. However, it is difficult to know actual count value of this sensitive material cartridge 51 of an apparatus according to this embodiment. Therefore, if the count value is incorrectly set to 8000 instead of 16000 but is actually much more than this value, then it is difficult to adequately guarantee the quality of sensitive material cartridge 51 up to the count value of 16000. Thus, in this case, the count value is falsely set to 16000 to give higher priority to guaranteeing quality of the cartridge. That is, when the user counter on the apparatus main body 42 indicates 16000 sheets or greater than 16000 sheets, the second fuse 118 is fused to cause the replacement prompting lamp 171 to flash on and off, thereby indicating that it is about time to replace the cartridge. Fusing the second fuse 118 will shift the replacement sensitive material cartridge 51 of the second type to the third type and may decrease the user benefits. Thus, second fuse 118 is not fused when sensitive cartridge 51 of the second type is merely loaded, leaving a chance that sensitive material cartridge 51 can be replaced again by the first type of cartridge which was originally present. In this example, the user would replace the second type sensitive material cartridge with the original first type which was previously loaded. If the cartridge is replaced by the second type without setting the replacement cartridge to the third type after a copy operation, limitations will be placed on the user benefit from a point of view of quality guarantee. It is assumed that a large copy operation is carried out when the second fuse 118 is fused in this circumstance. In this case the duplicator may be arranged to give the users some warning.

(iii) Finally, a case in which the count value of the user counter is greater than 18000 will be described.

In this case, the user counter will not count. The "J7" occurs requesting the user to replace sensitive material cartridge 51. Of course, the copy operation is not performed, thus sensitive material cartridge 51 of the second type is not converted to the third type. In this case, the user only requires replacement to the sensitive material cartridge of the original first type and does not have to stick to the cartridge of the second type.

(C) A case in which replacement is performed from the first type to the third type.

(i) In the case where the count value of the user counter is less than 16000, both the initialize counter and the user counter hold. This is to prevent the number of copies that are not guaranteed quality thereof since the number of copies must have been greater than 16000 if the cartridge 51 is of the third type. Thus, the "immediate J7" occurs in this case.

(ii) In the case where the count value of the user counter is greater than 16000 but less than 18000 when replacing the cartridge 51, the type of the cartridge 51 that is already present is the same as the cartridge loaded. Thus, the user counter may be allowed to continue counting in this case. However, the quality is not guaranteed at a count value greater than 16000 and therefore the replacement prompting lamp flashes on and off to prompt replacement of sensitive material cartridge 51.

(iii) If the count value of the user counter is greater than 18000 when replacing the cartridge, the user counter will not count up, in which case the "J7" occurs to request the user to replace sensitive matterial cartridge 51. In this case too, the user is required to replace the original cartridge with the first type of cartridge 51 and does not have to stick to the cartridge 51 of the third type for which the quality guarantee period has passed.

(D) In the case where replacement is performed from the second type to the first type, the operation will be exactly the same as that in the case where replacement is performed from the first type to the first type.

(E) In the case where replacement is performed from the second type to the second type, the initialize counter holds and only the user counter continues to count.

(F) In the case where the cartridge is replaced from the second type to the third type, the initialize counter is caused to hold its count value. This case is similar to a case in which the "immediate J7" is generated as shown in TABLE 1. Thus, both the initialize counter and the user counter hold the count value thereof.

(G) In the case where a third type cartridge is replaced with a first type cartridge, the initialize counter starts counting from its current value and the user counter holds its count value.

(H) In the case where a third type cartridge is replaced with a second type cartridge, the user counter continues to count. However, it is difficult to know the present count value of the cartridge only from the fact that the cartridge is of the second type. Thus upon copying one sheet, the second fuse 118 is fused for confirmation to change it to the third type cartridge.

(I) In the case where a third type cartridge is replaced with another third type cartridge, the initialize counter is not allowed to count but the user counter continues to count. However, since the third type is loaded, the replacement prompting lamp 171 flashes on and off thereby urging replacement of sensitive material cartridge 51.

The above-mentioned sensitive material cartridge 51 as a CRU (customer replaceable unit) has the following merits or objects:

(a) to enhance customers' satisfaction;

(b) to simplify the business and therefore decrease costs for the customers and the company dealing with production, maintenance and adjustment of the apparatus;

(c) to increase the reliability of the actual machine and the consistency of copy quality;

(d) to secure to the above-mentioned company the after-sale service;

(e) to increase the placement and market share;

(f) to shift from labor intensive service to high volume manufacturing quality and economics of scale; and (g) elimination of service, meter reading and service administration for the above-mentioned company.

(5-4-2) Processing when "J9" occurs.

FIG. 27 shows a case where the sensitive material cartridge 51 is replaced with the previously described "J9" being issued. (Prev. 2) at a left column of the FIG. 27 represents a first previously loaded type of sensitive material cartridge 51 and (Prev. 1) indicates a second previously loaded type of cartridge. "NEW" indicates the type of sensitive material cartridge 51 currently loaded after the replacement operations.

(A) Replacement of sensitive material cartridge 51 having the toner supm full as indicated by "J9" to the first type and then to the second type, will be described as follows.

The "J9" occurs when the user counter has counted less than 16000 and also the sump is full of the recovered toner, as mentioned previously. This situation conventionally occurs when sensitive cartridge 51 is a second type cartridge.

Replacing sensitive cartridge 51 with the "J9" having been issued with the first type, permits initiation of the copy operation. Replacing sensitive cartridge 51 with the "J9" having been issued, with the second type corresponds to a case in which the user count value is less than 16000 at replacement and the cartridges are, therefore, matched in terms of the count value. Thus, the user counter is allowed to continue counting.

Theoretically, the sump may become full of toner in connection with a first type cartridge 51. However, the initialize counter is operative at this time and the user counter may possibly indicate greater than 16000. This is because the user counter is reset when sensitive cartridge 51 is switched from the first type to the second type, where it is completely unknown what count value the user counter indicates.

When the first type sensitive cartridge 51 is loaded with the "J9" being set, the initialize counter counts up while the user counter will remain unchanged. Thus, when the second type sensitive materail cartridge 51 is loaded thereafter, a problem arises in whether or not the cartridge is matched with the user counter. This problem is not overcome by the procedure in uppermost column in FIG. 22 but is resolved by that shown in the column in FIG. 21B for replacement of the sensitive material cartridge from the first type to the second type. That is, considering three cases, i.e., when the user counter has counted less than 16000, greater than 16000 but less than 18000, a decision is made based on whether or not the user counter is to be continued or whether to change sensitive material cartridge 51 to the third type as required or the "J7" occurs.

(B) A case where a sensitive material cartridge 51 with the "J9" having been issued is replaced with the first type and this first type cartridge is replaced with a third type will be described as follows.

Replacing the first sensitive material cartridge 51 with the "J9" having been set with the first type permits initiation of the copy operation. Replacing the second sensitive material cartridge 51 of the first type with a third type with the user counter value being less than 16000, results in a cartridge from which more than 16000 sheets have been copied being loaded. Thus, if the copy operation is allowed in this situation, the copy quality will not be guaranteed up to a count value of 16000 of the user counter. Thus, both the initialize counter and the user counter hold and also the "immediate J7" occurs because this is a case in which a first type cartridge is replaced with the third type.

(C) A case where a sensitive material cartridge 51 with "J9" having been set is replaced with the second type and then the second type cartridge is replaced with the third type will be described.

Also, in this situation, if the copy operation is allowed, the copy quality will not be guaranteed up to a count value of 16000 of the user counter. Thus, both the initialize counter and the user counter hold and also the "immediate J7" is set because this is a case in which a second type cartridge is replaced with a third type.

(D) Then, a case where a sensitive material cartridge 51 with "J9" having been set is replaced with a first type cartridge will be described.

This replacement takes place when the sump becomes full of the recovered toner during the guarantee period where the count value of the user counter is less than 16000. In which case it is natural to replace the old cartridge with a first type.

Since the first type of sensitive material cartridge 51 is loaded, the initialize counter will count. To prevent the unnecessary extension of the guarantee period due to improper use of zero clear of the initialize counter, the initialize counter is allowed limited counting operation. In the case where the first "J9" occurs after the sensitive material cartridge 51 is shifted from the first type to the second type in the course of copy work, the initialize counter is cleared to zero upon loading of a brand new sensitive material cartridge 51 so that the users can have "bonus copy" up to 99 sheets, in which case a flag is set ON to inhibit a second zero clear. If the "J9" occurs in cases other than the above conditions, then the initialize counter is allowed to count from the present count value thereof (E) A case where a sensitive material cartridge 51 with "J9" having been set is replaced with the second type cartridge will be described.

"J9" occurs with the user counter having counted up less than 16000, thus the count value corresponds to the second type of cartridge used as a replacement. Thus, the user counter is to count up from the present value in this case.

(F) Finally, a case where a sensitive material cartridge 51 with "J9" having been set is replaced with the third type will be described.

In this case, the count value of the user count does not match the sensitive material cartridge used as a replacement. Thus, the count value of the user counter holds and the "immediate J7" occurs. The user, in this case, must replace the sensitive material cartridge 51 by the first or the second type.

(5-4-3). Processing when "IJ7" occurs

FIG. 28 illustrates process of replacing the sensitive material cartridge 51 when the "immediate J7" occurs.

(A) A case in which a sensitive material cartridge 51 with "immediate J7" having been set is replaced by a first type cartridge and then the first type cartridge is replaced by a second type cartridge will be described.

"Immediate J7" occurs when either a first or a second type sensitive material cartridge 51 each of which have a user count value of less than 16000 is replaced by the third type of cartridge. Thus, after the "immediate J7" has occurred, when the cartridge of the first type is loaded but not used or replaced again by the second type of cartridge in the course of use, the count value matches the count value when the "immediate J7" occurs. Therefore, the initialize counter holds in this case, while the user counter continues to count from the current count value.

(B) Next, a case in which a sensitive material cartridge 51 with "immediate J7" having been set is replaced by the first type of cartridge and then this first type of cartridge is replaced by the third type will be described as follows.

In this case, the count value does not match the cartridge type because the ultimate cartridge is the third type. Thus, the "immediate J7", which has been cancelled upon loading of the first type sensitive material cartridge 51, again occurs, prompting loading of the one the other types of cartridges.

(C) A case where a sensitive material cartridge 51 is replaced by the second type of cartridge and then this second type of cartridge is replaced by the third type will be described.

In this case, too, the "immediate J7" is cancelled upon loading of the second type of sensitive material cartridge 51. Once the third type of sensitive material cartridge 51 has been loaded, the condition is similar to that in the aforementioned case (B) thus, the "immediate J7" again occurs. When the "immediate J7" occurs, the loading of the first type of sensitive material cartridge is not essential in order to cancel the "immediate J7" because the third type cartridge 51 ca be replaced by the second type cartridge previously loaded in this case.

(D) Then, a case where a sensitive cartridge 51 with "immediate J7" having been set is replaced by the first type of cartridge will be described.

Procedure in this case is the same as that described in case (D) of "Processing when 'J9' occurs" in FIG. 27, in which abuse of the zero clear of the initialize counter by issuing "immediate J7" is prevented. That is, in the case where the first "immediate J7" occurs after the sensitive material cartridge 51 is shifted from the first type to the second type as a result of the copy work, the initialize counter is cleared to zero upon loading of a brand new sensitive material cartridge 51 so that the users can have "bonus copy" up to 99 sheets. In order to avoid awarding additional "bonus copy" a flag is subsequently set ON to inhibit a second zero clear. If the "immediate J7" occurs in the cases other than the above conditions, then the initialize counter is allowed to count from the present count value thereof.

(E) A case where a sensitive material cartridge 51 with "immediate J7" having been set is replaced by the second type of cartridge will be described.

"Immediate J7" occurs with the user counter having counted up to less than 16000, thus the count value matches the replaced second type of sensitive material cartridge 51. Thus, the user counter will count up from the present count value in this case.

(F) Finally, a case where a sensitive material cartridge 51 with "immediate J7" having been set is replaced by the third type will be described.

In this case, the count value of the user counter will not match the replaced sensitive material cartridge 51. Thus, the count value of the user counter holds and the "immediate J7" occurs. The user, in this case, can only use the first or the second type of sensitive cartridge 51 as a replacement.

(5-4-4) Processing when J7 occurs at a count greater than 18000 of the user counter FIG. 29 illustrates process of replacing a sensitive material cartridge with "J7" having been set when the count value of the user counter becomes greater than 18000.

The "J7" occurs in two cases: (i) When the user counter has counted up more than 18000 and sensitive material cartridge 51 is recognized to have expired its life-time in terms of the number of copies, and (ii) when the user counter has counted up more than 16000 but less than 18000 and the sump is full of the recovered toner thus the life-time of sensitive material cartridge 51 is recognized to have expired. In either case, the life-time expires after its guaranteed period for that sensitive material cartridge 51, thus the user is expected to replace the cartridge. The item (i) will be described in this section with reference to FIG. 29 (5-4-4) and the item (ii) will be described in the next section (5-4-5).

Referring to FIG. 29, each of the cases (A)-(E) will now be discussed.

(A) A case where a sensitive material cartridge 51 with "J7" having been set is replaced by the first type of cartridge and then this first type of cartridge is replaced by the second type will be described.

In this case the second type of sensitive material cartridge 51 is ultimately loaded thus the initialize counter stops counting. Since the user count has counted up more than 18000 already, it is unknown what count between "0" and "16000" should be set even though the second type sensitive material cartridge is loaded. Setting a count value (=8000) of a half of 16000 as a comprise value will extend the life-time of the sensitive material cartridge 51 without a good reason, failing to guarantee the quality of the cartridge. Therefore, in this case the user counter is also inhibited and the "J7" again occurs.

(B) A case where a sensitive material cartridge 51 with "J7" having been set is replaced by the first type of cartridge and then this first type of cartridge is replaced by the third type of cartridge will be described.

The situation in this case is the same as in (A), and the "J7" once again occurs.

In the two cases above-described, despite the fact that a cartridge of the first type exists, the cartridge is replaced again by another cartridge. Thus, reloading the first type of sensitive material cartridge 51 can initiate the copy operation. Request of replacement of the cartridge by the "J7" display can be thought of as an indication or an advisory that the copy operation can be initiated by loading the first type again.

(C) A case where a sensitive material cartridge 51 with "J7" having been set is replaced by the first type of cartridge will be described.

In this case a proper procedure is taken against abuse of the zero-clear of the initialize counter when the "J7" occurs. When the user counter has counted more than 18000 after the sensitive material cartridge 51 is shifted from the first type to the second type as a result of copy operation and then a first "J7" occurs, the initialize counter is cleared to zero upon loading of a brand new sensitive material cartridge 51 so that the users can have "bonus copies" of up to 99 sheets, in which case a flag is set ON for inhibiting a second zero clear. If the "J7" occurs in the cases other than the above conditions, then the initialize counter is allowed to count from its present count value.

(D) Then a case where a sensitive material cartridge 51 with the "J7" having been set is replaced by the second type of cartridge will be described.

With the duplicator according to this embodiment, the "J7" is set OFF only when the first type cartridge 51 is loaded into the apparatus main body 42. Thus, the "J7" is not set OFF in this case but remains ON prompting replacement of the sensitive material cartridge 51.

(E) Finally, the "J7" will remain ON for the reasons described previously when a sensitive material cartridge 51 with "J7" having been set is replaced by the third type of cartridge.

(5-4-5) Processing "J7" which occurs when the sump is full of toner at a count value of greater than 16000 of the user counter.

FIG. 30 illustrates replacement procedure for sensitive material cartridge 51 with "J7" having been set when the sump is full of the recovered toner and the count value of the user counter is greater than 16000 but less than 18000.

(A) First, a case in which a sensitive material cartridge 51 with "J7" having been set is replaced by the first type of cartridge and then that first type of cartridge is replaced by the second type of cartridge will be described.

In this case, the user count has counted less than 18000, thus use of the second type cartridge 51 is allowed providing that this second type cartridge is changed to the third type. This is because guarantee of copy quality is given higher priority since actual level of use of the second type sensitive material cartridge 51 used as a replacement is unknown. Switching to the third type immediately after loading the cartridge would not protect against a mistake in the choice of replacement cartridge. Therefore, the second fuse 118 is fused upon actual copy operation. Of course, as described previously, some sort of alarm indication may be given in advance of the cartridge type change.

(B) A case in which a sensitive material cartridge 51 with "J7" having been set is replaced by the first type of cartridge and then that first type of cartridge is replaced by the second type will be described.

In this case, the count value of the user counter matches the third type of cartridge which is the current cartridge to be loaded, thus the user counter continues to count. Also, since the third type sensitive material cartridge 51 is loaded, the replacement prompting lamp 171 alternately flashes on and off thereby prompting replacement of sensitive material cartridge 51.

(C) A case in which a sensitive material cartridge 51 with "J7" having been set is replaced by the first type of cartridge will be described.

In this case, steps are taken to prevent abuse of the zeroclear of the initialize counter when the "J7" occurs. If a first "J7" occurs when the sump becomes full of the toner with the user counter having counted less than 16000 after the sensitive material cartridge 51 is shifted from the first type to the second type as a result of progressive copy operation, the initialize counter is cleared to zero upon loading of a brand new sensitive material cartridge 51 so that the users can have "bonus copy" up to 99 sheets, in which case a flag is set ON for inhibiting a second zero-clear. If the "J7" occurs in the cases other than the above conditions, then the initialize counter is allowed to count from its present count value.

(D) A case in which a sensitive material cartridge 51 with "J7" having been set is replaced by the first type of cartridge will be described.

This case is similar to the previous case (C) of FIG. 24 in which the count value of the user counter has been more than 18000 and the "J7" occurs. Accordingly, the "J7" is not set OFF and replacement of the cartridge 51 is prompted subsequently.

(E) Finally, the "J7" will remain ON for the reasons described previously, i.e., case (E) of FIG. 24 when the sensitive material cartridge 51 is replaced from "J7" to the third type.

(5-5) Control logic for replacement of the cartridge

Figure 31:
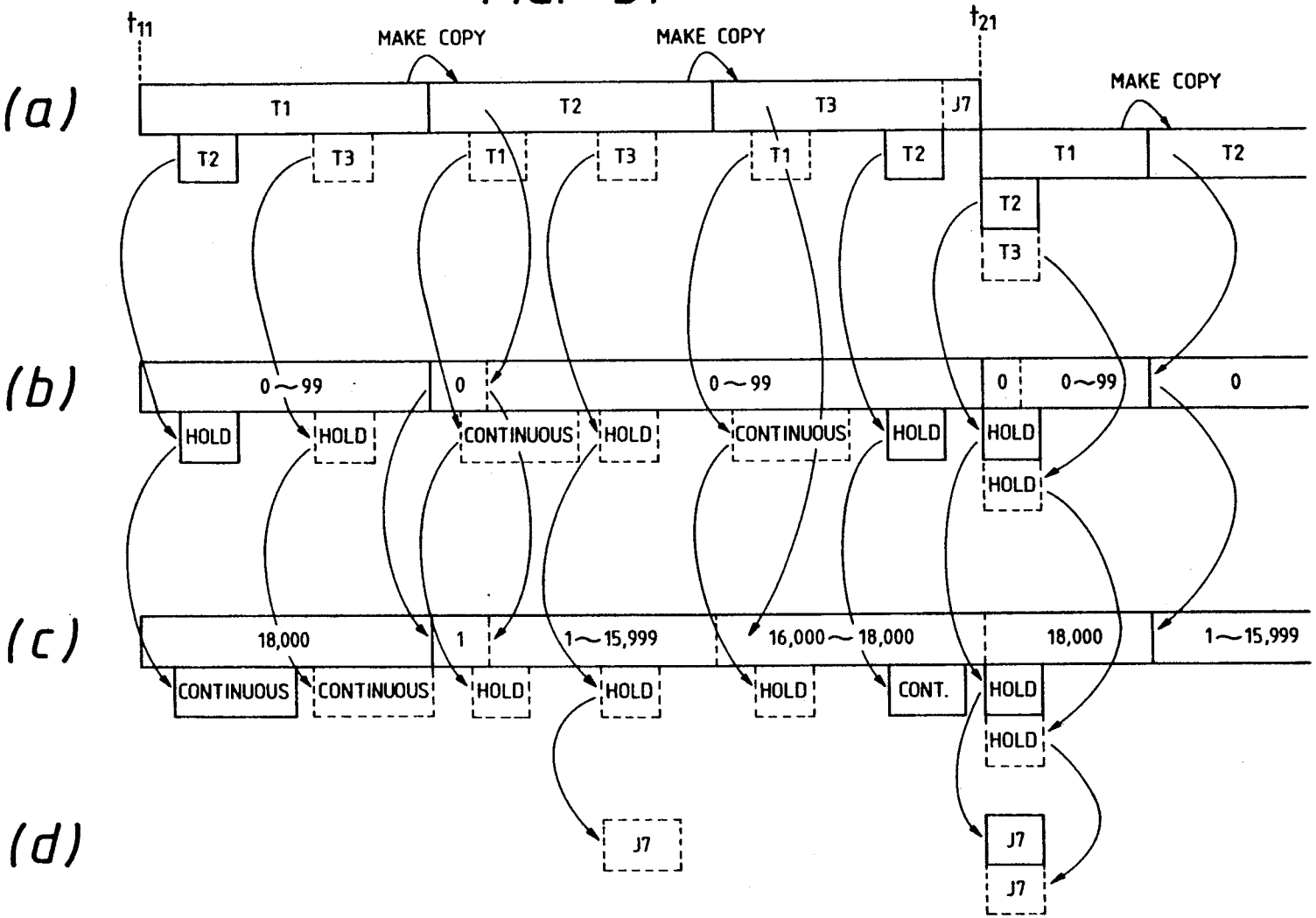

Summary of the control logic for replacing the sensitive material cartridge 51 will be described so as to generally summarize the description thus far presented. FIG. 31-a shows sensitive material cartridge 51 grouped with respect to types, and FIG. 31-b illustrates the count value of the initialize counter. FIG. 31-c shows the count value of the user counter and FIG. 31-d illustrates how the "J7" and "immediate J7" occur. Abscisa in FIG. 31-c represents elapse of time.

Now, assume that a senstive material cartridge 51 of the first type T1 is loaded at time T11. In this case, the initialize counter counts up each time the cop is made and is cleared to zero at a first copy after the count value becomes "99". At this time, the sensitive material cartridge 51 shifts from the first type T1 to the second type T2. Thereafter, the initialize counter holds a count value ranging from "0" to "99". This is because, when the duplicator malfunctions, the initialize counter counts up in response to checkups performed by the service man loading a first type sensitive material cartridge 51 that he brought.

In the meantime, the user counter indicates a count value of, for example, 18000 at the time T11 but will not count as long as the loaded cartridge 51 is of the first type T1. When one copy is made at the count value of "99" of the user counter, the cartridge 51 shifts to the second type T2 thereby causing the user counter to be set to "1". Thereafter, each time a copy is made the user counter counts up by a unit. Then, when copy is made after the user counter reached a count value of "15999", the sensitive material cartridge 51 shifts from the second type T2 to the third type T3. The first count value of the user counter when the cartridge changes to the third type is "16000" and is incremented by a unit each time a sheet of copy is made.

When the count value for the third type T3 reaches "18000", "J7" occurs as shown by FIG. 31-a. When copying in succession, the count value grows till this copy operation is completed and the ultimate life-time is actually extended accordingly, though the copies made from this third type T3 are not guaranteed. Also, when the sump becomes full of the recover toner with respect to the third type T3, the life-time of the cartridge expires. When the "J7" occurs, the user replaces the cartridge by a new sensitive material cartridge 51. The initialize counter is zero-cleared at time T21 and thereafter the same control as before will be repeated.

Lower portion of FIG. 31-a represents the operation of in which sensitive material cartridges 51 used as replacements. For example, if first type T1 is replaced by second type T2 at a time slightly past the time t11, then the initialize counter will enter the hold condition and the user counter will count up if it has counted less than 16000 and less than 18000. The control in this case will break down to three types as described referring to FIG. 7 but FIG. 31 shows only a typical one.

Another example of replacement in the first type T1 is a replacement to the third type T3 shown by a dotted line in FIG. 31-a. The use of a dotted line instead of a solid line does not signify any difference in operation but only visually distinguishes individual examples. In this example of replacement of a first type T1 cartridge by a third type T3 cartridge, the initialize counter will enter the hold condition and the user counter will count up, for example. If the user counter has counted less than 16000 then the "immediate J7" occurs, though not shown in FIG. 31.

The example "two types" after this which shows replacement of a second type T2 by a third type T3 involves "immediate J7." In this example, the user counter will hold and the "immediate J7" occurs since the count value of the user counter is in the range from "1" to "15999".

Although the embodiments thus far described have been described by way of example of a sensitive material cartridge as a consumable part material (or CRU, a customer replaceable unit material), the present invention may be applied to consumable parts such as the sensitive material alone or those parts comprising no sensitive material. Such consumable parts can be defined in a wide variety ways including exposure lamps, scanner units, heat rolls or fuser units in addition to those described previously, considering only the duplicators. Setting prices in terms of life-time and quality of these components permits the users to select most suitable CRU's for their apparatus and to arrange an optimum apparatus. The embodiment has been described by way of example of the duplicator but the invention may also be applied to other general storage apparatuses.

As described in detail according to the preferred embodiment of the present invention, provision of a state setting means on the main body of a consumable part of a component for seting the condition of consuming in a plurality of steps, permits not only indication of consuming as in a counter that not only indicates conditions of consuming but also supervision of the state. In other words, in the case where the consumable part component is replaced, its constituents in part for extended life-time, the consumable part may be changed to be set to its earlier state depending on arrangement of the apparatus, thereby allowing rational and economic supervision of the consumable part.

Also, according to the preferred embodiment of the present invention, a counter for counting the number of sheets of copies which have been made is disposed on the main body of the storage apparatus. Thus, it is not necessary to provide consumable part with a complicated mechanism for detecting life-time of the CRU (consumable part). Further, supervision of the states of the consumable parts which are to be loaded into the storage apparatus can provide a measure for assuring that the customer benefits from the full life-time of the consumable part. The consumable part (CRU) according to the invention permits a practical purchasing-schedule and supervision based on the number of sheets of copies that are guarenteed for a particular consumable part, while the prior art consumable part can only indicate an average life-time of the particular consumable part, such as, the average time for toner contained therein to run out.

Also, for example, according to the invention, even if the consumable part is replaced when it is not necessary to replace that consumable part, a suitable measure of life-time can be taken in accordance with the conditions of that consumable part and the apparatus, thereby harmonizing guarantee of quality of the replacement consumable part component and benefit of the users.

Also, according to the invention, when some kind of abnormality occurs in the consumable part which requires that it be replaced, a reasonable measure life-time can be taken in accordance with the conditions of the consumable part and the apparatus main body, thereby balancing guarantee of quality of the consumable part component and benefit of the users.

Also, for example, according to the invention, when a consumable part of a different type is loaded into the apparatus main body, the main body is adapted to detect it and inhibit storage operation. Thus storage quality is assured as well as quality of the consumable part is guaranteed to the users regardless of the detection of a different type of consumable part.

It will be apparent to those skilled in the art that various modifications and variations can be made in the storage apparatus of the present invention without departing from the or spirit of the invention. Thus it is intended that the present invention cover the modifications and variations of this invention provided they come within the scope of the appended claims and their equivalents.

What is claimed is:

1. An apparatus for making copies comprising:
a main body;
a consumable part detachably coupled to said main body;
counting means for counting the number of copies made with a specific consumable part coupled to said main body;
state detection means for detecting the level of consumption of said consumable part, and
a life-time decision means for deciding the life-time of said consumable part in response to said state detection means and said counting means.

2. An apparatus according to claim 1, further including:
an abnormality detection means for detecting an abnormal state of the consumable part; and
means in said life-time decision means for deciding the expiration of the life-time of said consumable part in response to said abnormality detection means.

3. An image copying apparatus comprising:
a transfer means for transferring a toner image onto a sheet of paper;
for detecting each sheet of paper on which toner images have been transferred;
logic means for generating an output in response to said paper detection means detecting a sheet; and
counting means for counting said output from said logic means.

4. The apparatus according to claim 3, further including:
a consumption-level setting means for setting successive levels of consumption of a predetermined consumable part of the apparatus in accordance with the counted value of said counter, and a life-time prediction means for detecting the expiration of the life-time of said consumable part when said levels of consumption set by said consumption level setting means reaches a final level in succession.

5. An apparatus comprising:

a main body;

a consumable part detachably coupled to said main body;

a counter;

a consumption level setting means for setting successive levels of consumption of a predetermined consumable part in accordance with the counted value of said counter;

a load-timing detection means for detecting a time at which said consumable part is coupled to said main body and storing consumption level information for the most recently coupled consumable part;

a consumption-comparison means for comparing consumption levels of said consumable part currently coupled to said main body to consumption levels stored in said load timing detection means; and a life-time setting means for setting a life-time of the consumable part currently loaded into the main body to a predetermined value on the basis of the comparison result from said consumption-comparison means and a content of said counter.

6. The apparatus according to claim 5, further including:

a detection means for detecting that said consumable part is unloaded from said main body; and a consumption-level-change inhibitting means for inhibitting the consumption-level setting means from changing the consumption level when the detection means defects unloading of said consumable part.

7. An apparatus for storing information on sheets of paper, said apparatus comprising:

a main body;

a consumable part detachably coupled to said main body said consumable part having levels of consumption, certain of said levels being designated as states;

a state detection means for detecting which of said states said consumable part is in when coupled to said main body;

a counting means for counting the number of sheets of paper on which information has been stored; and a normal-time consumable part process decision means for deciding processing of said consumable part loaded in accordance with a state detected by said state detection means and a content of said counter.

8. The apparatus defined in claim 7, wherein said normal-time consumable part process decision means includes a count-inhibition means for inhibitting a count-operation of said count means.

9. The storage apparatus defined in claim 7, wherein said normal-time consumable part process decision means includes a condition-change means for changing the state of the consumable part to another state.

10. The apparatus defined in claim 9, further including a confirmation-indicating means for confirming and indicating a change before said condition-change means changes the state.

11. A apparatus for storing information on sheets of paper, said apparatus comprising:

a main body;

a consumable part detachably coupled to said main body having levels of consumption, certain of said levels being designated as states;

an abnormality detection means for detecting an abnormal condition of the consumable part when said consumable part is coupled to said main body;

a counting means for counting the number of sheets of paper on which information has been stored; and an abnormal-time consumable part process decision means for deciding the status of the consumable part coupled to said main body in response to said abnormal condition detected by said abnormality-detecting means and a count value of said counting means.

12. An apparatus for storing information on sheets of paper, said apparatus comprising:

a main body;

a consumable part detachably coupled to said main body;

a distinguishing means mounted on said consumable part having a characteristic response to electronic signals; and a comparison means disposed on said main body for comparing said response of the distinguishing means with a preselected response to a given electronic signal.

13. The apparatus defined in claim 12 further including means for counting the number of sheets having information stored therein; and use-inhibiting means for inhibiting the use of the specific consumable part when the counting means has counted a number of sheets on which information has been stored in excess of a predetermined count.

14. An apparatus as defined in claim 13, further including:

storage means for performing operations to store information on a plurality of sheets of paper in succession; and a use-inhibition delaying means for delaying operation of said use-inhibiting means until said storage means completes a series of storage operations.

15. An apparatus according to claim 12, wherein:

said main body has an internal power supply, a volatile memory, a battery for backing up said volatile memory, and wherein said apparatus further includes, a voltage detection means connected to said internal power supply in said main body being energized by said internal power supply for detecting the expiration of said battery lifetime in accordance with the voltage of said battery; and a display means for displaying an indication of said expiration in response to said voltage detection means.

16. An apparatus comprising:

a main body;

a consumable part detachably loaded to said main body;

a first shut-off switch and a second shut-off switch mounted on said consumable part;

count means mounted on said main body for counting the life-time of said consumable part;

a first current supply means for supplying the first shut-off switch with current to shut off said first shut-off switch when said count means performs a first count; and a second current supply means for supplying the second shut-off switch with current to shut off said second shut-off switch when said count means performs a second count.

17. A storage apparatus comprising:

a main body, a consumable part loaded in said main body;

a resistor provided on said consumable part;

a resistance-decision means disposed in said main body for deciding whether or not a resistance value of said resistor is within a given range of resistance; and a consumable part operation control means for allowing operation of said consumable part when said resistance-decision means decides that the resistance value is within said given range.

* * * * *

UNITED STATES PATENT AND TRADEMARK OFFICE

CERTIFICATE OF CORRECTION

PATENT NO. : 5,021,828

DATED : June 4, 1991

INVENTOR(S) : Junichi Yamaguchi et al

It is certified that error appears in the above-identified patent and that said Letters Patent is hereby corrected as shown below:

Claim 3, column 34, line 57, before "for" insert --paper detection means--.

Claim 6, column 35, line 34, change "inhibitting" to --inhibiting--.

Claim 8, column 35, line 57, change "inhibitting" to --inhibiting--.

Signed and Sealed this

Thirteenth Day of April, 1993

*Attest:*

STEPHEN G. KUNIN

*Attesting Officer*

*Acting Commissioner of Patents and Trademarks*